US006527055B1

(12) United States Patent
Gipson

(10) Patent No.: US 6,527,055 B1
(45) Date of Patent: Mar. 4, 2003

(54) THRUST ENHANCEMENT DEVICE FOR COILED TUBING INJECTORS

(75) Inventor: Thomas C. Gipson, Eastland, TX (US)

(73) Assignee: Coiled Tubing Solutions, Inc., Eastland, TX (US)

( * ) Notice: Subject to any disclaimer, the term of this patent is extended or adjusted under 35 U.S.C. 154(b) by 243 days.

(21) Appl. No.: 09/966,444

(22) Filed: Sep. 28, 2001

(51) Int. Cl.[7] ..... E21B 19/00

(52) U.S. Cl. ..... 166/379; 166/384; 166/77.2; 166/85.5; 166/242.2

(58) Field of Search ..... 166/384, 379, 166/55, 77.1, 77.2, 85.5, 242.2

(56) References Cited

U.S. PATENT DOCUMENTS 4,561,923 A * 12/1985 De Lorenzi et al.
5,515,926 A * 5/1996 Boychuk

* cited by examiner

*Primary Examiner*—Roger Schoeppel
(74) *Attorney, Agent, or Firm*—Elizabeth R. Hall

(57) ABSTRACT

A means and method for improving the injection of coiled tubing into and from a well by providing a secondary injection device for supplementing the thrust forces of the primary injector means. Use of the secondary injection device coacting in tandem with the coiled tubing injector permits developing significantly higher axial forces in the tubing than can be provided by the primary injector alone. The selectably operable thrust enhancement device of this invention provides a short, repeatable stroke in either direction. The thrust enhancement device operates by selectably gripping the tubing with a reciprocably moveable means in a first position, shifting the moveable means to a second position thereby moving the tubing, gripping the tubing with a static means at its new position, releasing the tubing from the moveable means, and returning the moveable means to its first position. When the thrust enhancement device is not needed for the injection operation, its gripping means are disengaged from the tubing.

20 Claims, 15 Drawing Sheets

THRUST ENHANCEMENT DEVICE FOR COILED TUBING INJECTORS

FIELD OF THE INVENTION

The present invention relates to a method and apparatus for increasing the thrust applied to coiled tubing over that applied by its injector alone during its injection into and withdrawal from a well bore. The apparatus of the invention is mounted in series with an injector and is used in situations where additional thrusting force is required to cause the tubing in the well bore to overcome high resisting forces due to obstructions, the annulus being sanded up, or the like. The apparatus provides a short, repeatable reciprocating stroke in either direction.

BACKGROUND OF THE INVENTION

Devices and methods for injecting coiled tubing into and retrieving it from wells are well known. Prior art injection systems include U.S. Pat. Nos. 6,142,406; 5,842,530; 5,839,514; 5,553,668; 5,309,990; 5,244,046; 5,234,053; 5,188,174; 5,094,340; 4,899,823; 4,673,035; 4,655,291; 4,585,061; and many other similar disclosures. In the prior art an injector at the wellhead is used to grip and control the injection and withdrawal of the tubing.

Conventional track injectors utilize gripper blocks mounted on two continuous parallel and opposed conveyor chains which are urged or pushed against the outer surface of the tubing. The interface forces between the gripper blocks and the tubing permit developing frictional forces which are used to transfer tangential loads from the conveyor chains to the tubing and vice versa. If insufficient interface force is applied to the tubing by the gripper blocks, slippage with attendant loss of control and wear occurs between the blocks and tubing. If excessive interface force is applied to the tubing by the gripper blocks, the tubing wall may be distorted and damaged or the injector may be damaged. A problem with such tracks results when the track is rotated into or out of engagement with the tubing from the sprockets at the ends of the track mounting assembly. This rotation can cause differential movement between the track and the tubing in the direction of the tubing axis so that rubbing occurs. This rubbing will cause undesirable wear of both the tubing and the gripper blocks.

Historically, the approach used to increase the injection forces with conventional track injectors has been to lengthen the injector while maintaining a sufficiently safe interface force between the individual gripper blocks and the tubing. U.S. Pat. No. 5,842,530 for example shows provision of substantially more gripper blocks along the length of its injector.

Other injectors utilizing two continuous, parallel, and opposing track injectors having grooved shoes or blocks mounted thereon are known in the art. These opposing track units have facing portions where the multiplicity of gripping blocks run parallel for gripping the tubing therebetween and are typically positioned in line, directly adjacent and above the wellhead.

Another approach has been to utilize a large diameter driven wheel with an annularly is grooved outer diameter to conform to and support the tubing. Relatively small-diameter hold-down idler rollers radially press the tubing against the wheel to provide extra interface force between the tubing and the wheel so that high tangential frictional forces can be imparted to the tubing by the wheel without maintaining large back tensions. These hold-down rollers have arcuate faces to match the tubing. One such wheel type injector is disclosed in U.S. Pat. No. 5,839,514.

A more recent injector system known in the art is a linear injector, which pulls on only one side of the tubing. For this type of device, coiled tubing is driven along a single linear section of an endless chain conveyor with normal forces being applied by an opposing linear array of small-diameter arcuate face hold-down idler rollers. These hold-down rollers are sized to conform to the tubing. Such a linear or one-track injector eliminates the necessity of synchronizing the two opposed sides of a conventional track type injector and is less damaging to the surface of the coiled tubing, but it requires a much longer unit, which of necessity extends much higher and requires additional overhead clearance. Additionally, such an injector is more expensive because it requires a considerable number of gripper blocks and rollers and a longer support track.

Copending U.S. Provisional Patent Application "Coiled Tubing Injector Utilizing Opposed Drive Modules and Having an Integral Bender", Ser. No. 60/304,681, filed Jul. 11, 2001, utilizes a novel approach to imparting tangential injection forces to the tubing. That invention provides support over a larger portion of the tubing circumference by positioning the driving means around the circumference of the tubing. By using a plurality of sets of opposed individually driven annularly grooved rollers which closely conform to the tubing and alternating the orientations of adjacent roller sets so that they are 90° apart about the through axis of the injector, excellent tubing support is provided. That invention is economical and efficient, as well as being lightweight, compact, easy to service and adapt for different tubing sizes.

A major problem with tubing injectors of all types is providing sufficient injection force on the tubing so that not only normal, smoothly operating injection loads are provided, but also sufficient injection force is available to overcome temporary, abnormally high resistances to tubing movement. Such abnormally high loads normally would be the result of a buildup of sand around the tubing, hanging up on a shoulder within the well, or other similar unexpected problems. Generally, such abnormally high loads only occur over a short section of a given well bore, if at all. The conventional means for overcoming such abnormally high injection forces is to use an injector which is able to provide the maximum push/pull required. Generally, the result of such an approach is that the injector is oversized for conventional non-problematic operation. Resulting in an injector that is larger, heavier, and more expensive to build and operate than is necessary for routine operations.

There exist a need for a simple and efficient method to provide an injection force in excess of that required for routine, non-problematic operation without having to provide an injector built to supply the maximum force predicted to be needed in the field.

SUMMARY OF THE INVENTION

The present invention utilizes a novel means and method for improving the system of injecting of coiled tubing into and from a well by providing a secondary injection device for supplementing the primary injector means. The secondary injection device is used to increase the axial forces in the tubing over the force provided by the primary injector alone. The selectably operable thrust enhancement device of this invention provides a short, repeatable stroke in either direction. The thrust enhancement device operates by gripping the tubing with a reciprocably moveable means in a first position, moving the moveable means to a second position thereby moving the tubing, then gripping the tubing with a static means at its new position, releasing the tubing from the moveable means, and returning the moveable means to its first position. When the thrust enhancement device is not needed for the injection operation, it is disengaged from the tubing.

One aspect of the invention is a coiled tubing injection system for moving coiled tubing into or out of a wellbore comprising a coiled tubing injector; a static tubing gripper having a closed and an open position; and a moveable tubing gripper having a closed and an open position, said movable tubing gripper being coaxially reciprocable between a first and a second position; wherein the coiled tubing injector, the static tubing gripper and the moveable tubing gripper are positioned coaxially along a length of coiled tubing and are independently selectively operable.

Another aspect of the invention is a coiled tubing injection system for moving coiled tubing into or out of a wellbore comprising a coiled tubing injector; a tubular body having a static transverse deck and a moveable transverse deck with the moveable transverse deck is coaxially reciprocable between a first and a second position; a first tubing gripper attached to the static transverse deck and a second tubing gripper attached to the moveable transverse deck. The first tubing gripper has a first and a second side, each having a back end, a central portion and a front end. The first and second sides are connected at the back ends and have a circularly arcuate groove in the central portion, where the interior surface of the groove serves as a tubing gripping surface when the first tubing gripper is in a closed position. When the first tubing gripper is in an open position the front ends of the first and second sides are separated and when it is in a closed position the front ends of the first and second sides are urged together. Similarly, the second tubing gripper has a first and a second side, each side having a back end, a central portion and a front end. The first and second sides are connected together on the back ends and have a circularly arcuate groove in the central portion, where an interior surface of the groove serves as a tubing gripping surface when the second tubing gripper is in a closed position. The second tubing gripper is in an open position when the front ends of the first and second sides are separated and in a closed position when the front ends of the first and second sides are urged together. The second tubing gripper reciprocates between a first location and a second location in tandem with the reciprocation of said moveable transverse deck between the first position and second position. The coiled tubing injector, the opening and closing of the first tubing gripper, the opening and closing of the second tubing gripper and the reciprocation of the moveable transverse deck are independently selectively operable.

Yet another aspect of the invention is a method for moving coiled tubing into or out of a wellbore using a coiled tubing injector and a thrust enhancer where the thrust enhancer comprises: (i) a tubular body having a static transverse deck and a moveable transverse deck, with the moveable transverse deck coaxially reciprocable between a first and a second position within the tubular body; (ii) a first tubing gripper attached to the static transverse deck, the first tubing gripper having a closed and an open position and an interior surface that serves as a tubing gripping surface when the first tubing gripper is in a closed position; and (iii) a second tubing gripper attached to the moveable transverse deck and reciprocating in tandem with the moveable transverse deck, where the second tubing gripper has a closed and an open position and an interior surface that serves as a tubing gripping surface when the second tubing gripper is in a closed position. The method comprising the steps of: (1) coaxially attaching the thrust enhancer to the coiled tubing injector, (b) feeding a coiled tubing through the functional path of the coiled tubing injector and the first and second tubing grippers; (c) engaging the coiled tubing injector to move tubing into or out of a wellbore; (d) closing the second tubing gripper so that its interior surface will grasp the surface of the coiled tubing; (e) moving the moveable transverse deck from the first position to the second position; (f) closing the first tubing gripper such that it grasps the surface of the coiled tubing; (g) disengaging the second tubing gripper; and (h) moving the moveable transverse deck from the second position back to its first position. Thus, the thrust applied to the coiled tubing is greater than the thrust applied by the coiled tubing injector or the thrust enhancer alone.

BRIEF DESCRIPTION OF THE DRAWINGS

The novel features which are believed to be characteristic of the invention, both as to its organization and methods of operation, together with the objects and advantages thereof, will be better understood from the following description taken in conjunction with the accompanying drawings, wherein.

DETAILED DESCRIPTION OF THE PREFERRED EMBODIMENTS

Figure 1:
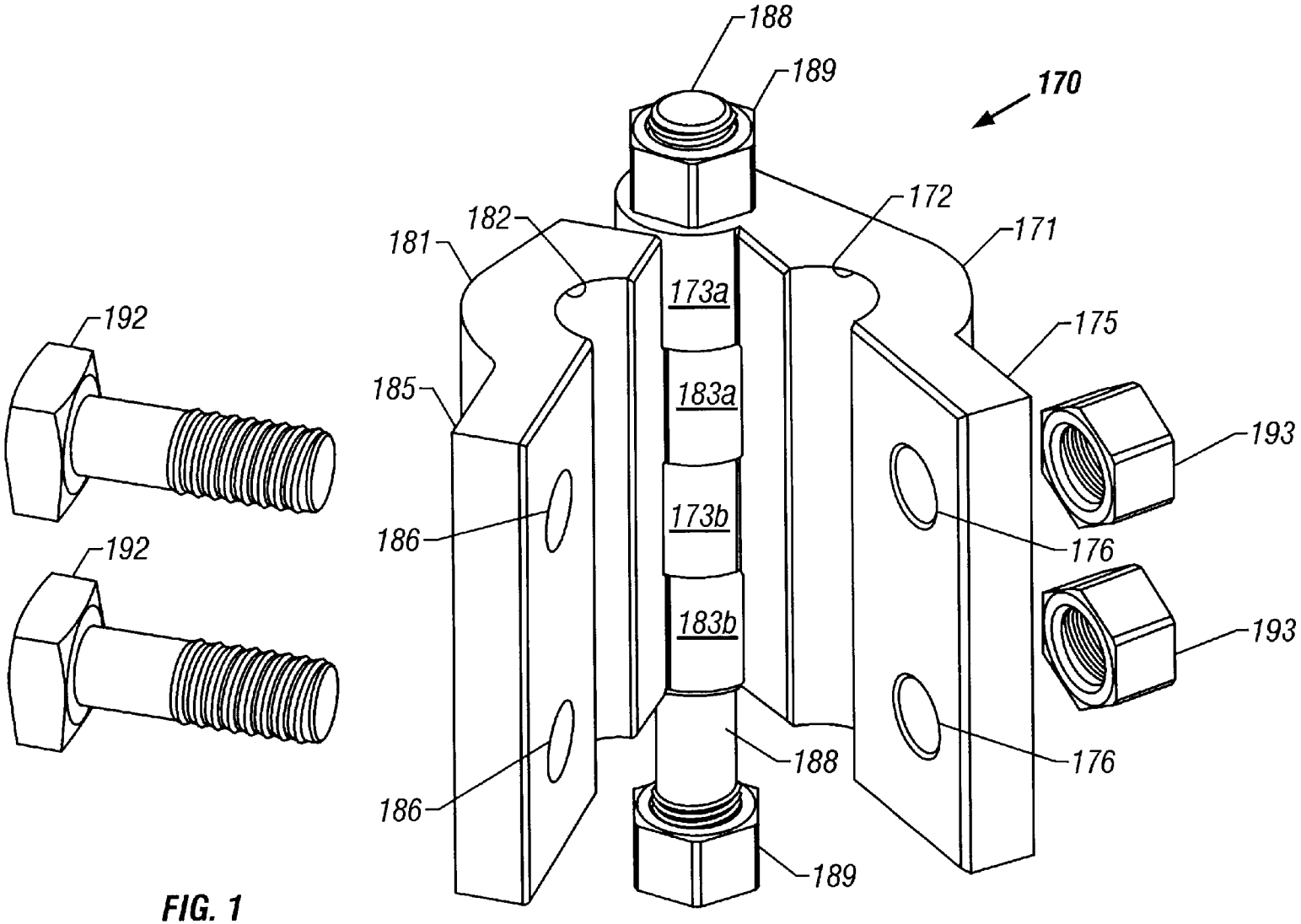
FIG. 1 is an oblique view of an opened manually operated tubing clamp.

Referring now to the drawings and initially to FIG. 1, it is pointed out that like reference characters designate like or similar parts throughout the drawings. The Figures, or drawings, are not intended to be to scale. For example, purely for the sake of greater clarity in the drawings, wall thickness and spacing are not dimensioned as they actually exist in the assembled embodiment. The materials of construction can be varied, but are preferably either mild or high-strength low-alloy steel.

Referring to FIGS. 1 through 4, the manual tubing clamp 170 used in a manually operated embodiment of this invention is shown in both an exploded and an assembled, closed oblique view and also assembled in both open and closed views down the tubing axis. Manual tubing clamp 170 consists of right-hand gripper 171, left-hand gripper 181, a hinge shaft 188 with hinge nuts 189, and a pair of clamp bolts 192 with associated clamp nuts 193. Right-hand gripper 171 has a flat vertical interior face with a vertical axis circularly arcuate groove, which serves as a tubing gripping, face 172 positioned in the middle portion of the vertical interior face. The axis of the arcuate groove is spaced slightly away from and outside the vertical interior face so that the arc of the vertical arcuate groove is less than 180°, and the diameter of the gripping face 172 corresponds to that of the tubing with which the gripper will be used. At one side of the vertical interior face two spaced apart hinge eyes 173*a,b* are formed, with eye 173*a* at the top and eye 173*b* just below midheight. Hinge eyes 173*a,b* are short cylindrical elements with coaxial vertical axes which are spaced slightly away from and outside the flat vertical interior face. The outer cylindrical faces of hinge eyes 173*a,b* are tangent to the exterior vertical face of right-hand gripper 171. The wall thickness of right-hand gripper 171 is thickened adjacent tubing gripping face 172 to support high bending stresses in that region. Vertical hinge bolt hole 174 is bored coaxially with the hinge eyes 173*a,b* and passes through both those eyes. Clamping ear 175 is formed on the opposite side of right-hand gripper 171 from the hinge eyes 173*a,b* and has its outer face parallel to the vertical interior face. The horizontal top and bottom surfaces and the outer transverse side of clamping ear 175 are flat. Through clamping bolt holes 176 are located in clamping ear 175 normal to the vertical interior face and symmetrically spaced about the horizontal midplane of right-hand gripper 171.

Left-hand gripper 181 is substantially identical to right-band gripper 171, except for the provision of an antirotation pocket for boltheads on its outer face. Left-hand gripper 181 has a flat vertical interior face with a vertical axis circularly arcuate groove, which serves as a tubing gripping, face 182 positioned in the middle portion of its vertical interior face. The axis of the arcuate groove is spaced slightly away from and outside the vertical interior face so that the arc of the vertical arcuate groove is less than 180°, and the diameter of the gripping face 182 corresponds to that of the tubing with which the gripper will be used. At one side of the vertical interior face two spaced apart hinge eyes 183*a,b* are formed, with eye 183*b* at the bottom and eye 183*b* just below midheight. Hinge eyes 183*a,b* are short cylindrical elements with coaxial vertical axes which are spaced slightly away from and outside the flat vertical interior face. The outer cylindrical faces of hinge eyes 183*a,b* are tangent to the exterior vertical face of left-hand gripper 181. The wall thickness of left-hand gripper 181 is thickened adjacent tubing gripping face 182 to support high bending stresses in that region. Vertical hinge bolt hole 174 is bored coaxially with the hinge eyes 183*a,b* and passes through both those eyes. Clamping ear 185 is formed on the opposite side of left-hand gripper 181 from the hinge eyes 183*a,b* and has its outer face parallel to the vertical interior face. The horizontal top and bottom surfaces and the outer transverse side of clamping ear 185 are flat. Through clamping bolt holes 186 are located in clamping ear 185 normal to the vertical interior face and symmetrically spaced about the horizontal midplane of left-hand gripper 181. Identical extensions of the exterior flat external face of clamping ear 185 extend into the thickened wall of left-hand gripper to accommodate the enlarged heads of clamp bolts 192. These extensions have inboard vertical edges normal to the exterior flat external face of clamping ear 185 which are offset laterally from the centerline of clamping bolt holes 186 by a distance equal to or slightly more than the eccentricity of the bolt head flats from the clamp bolt axis.

Figure 2:
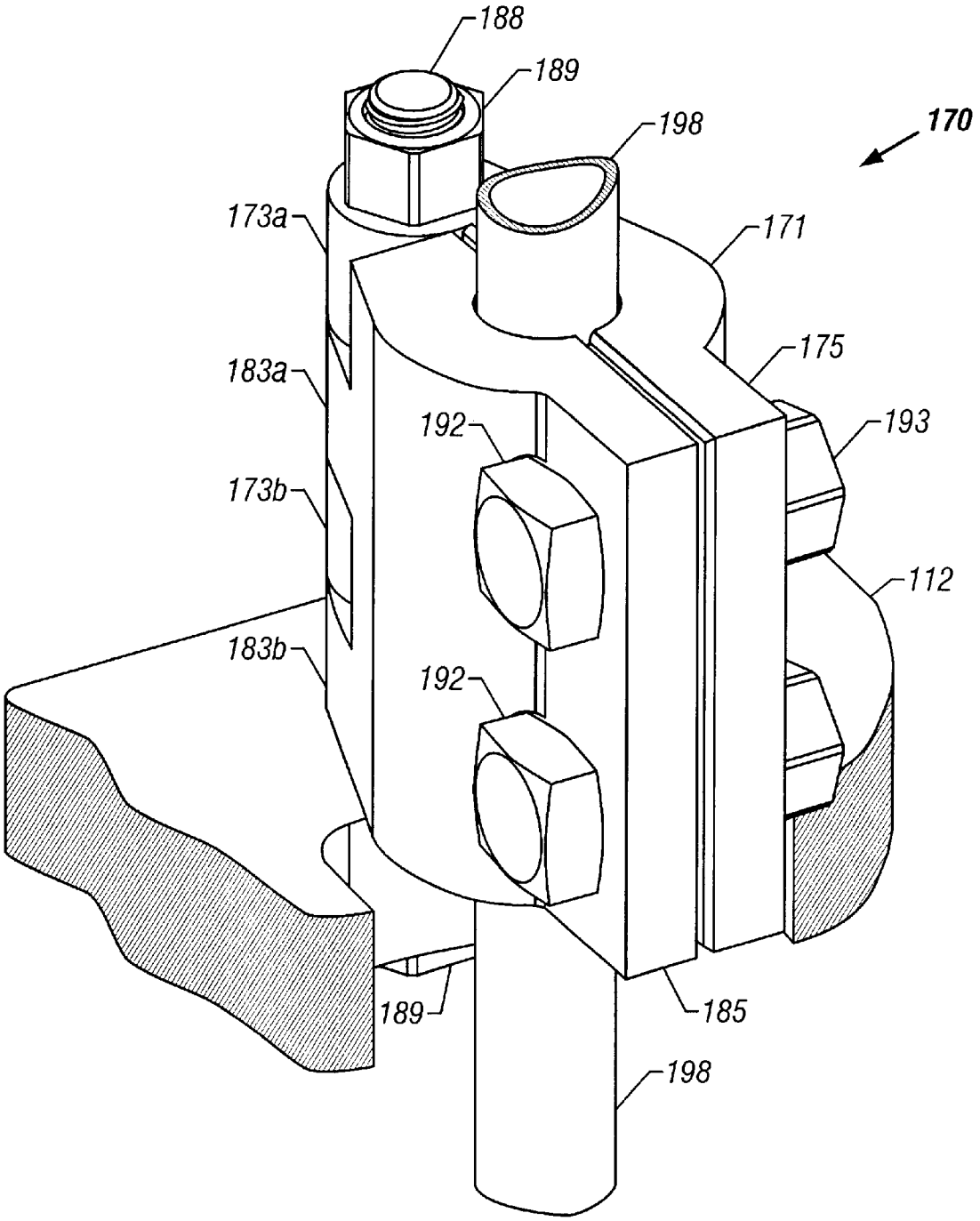
FIG. 2 is an oblique view of the clamp of FIG. 1 shown mounted to a support surface and gripping a section of tubing.

Left-hand gripper 181 has its hinge eyes 183*a,b* coaxial with the hinge eyes 173*a,b* of right-hand gripper 171 and is mounted inverted relative to the right-hand gripper. The length and position of hinge eyes 173*a,b* and 183*a,b* are such that they intermesh closely when right-band gripper 171 and left-hand gripper 181 are positioned together. Hinge shaft 188 is a long cylindrical round shaft with male threads at both ends. Hinge shaft 188 has a close sliding fit into the hinge bolt hole 174 and serves as a pivot and mounting shaft for the right-hand and left-hand grippers. Hinge shaft 188 is made sufficiently long so that it can be inserted through a supporting base for the manual tubing clamp 170 and thereby support the clamp. Internally threaded clamp nuts 189 are mounted on the top and bottom threaded portions of hinge shaft 188 to cause the components of the clamp assembly to fit closely to themselves and to their mounting base. In particular, the hinge eyes 173*a,b* and 183*a,b* interleave with a close fit to minimize axial play of the grippers on hinge shaft 188. Clamp bolts 192 are inserted through clamping bolt holes 186 and 176 of, respectively, the left-hand gripper 181 and the right-band gripper 171 so that a flat on the head of each of the clamp bolts will abut the vertical transverse face of the exterior flat face extensions when the bolts are torqued. A clamp nut 193 is threaded onto the end of each of clamp bolt 192. Approximately round coiled tubing 198 may be deployed within the arcuate tubing gripping faces 172 and 182 as shown in FIG. 2.

Powered tubing clamp 40, shown in FIGS. 5,6,7, and 8, is similar in many respects to manual tubing clamp 170, but uses a selectably operable hydraulically driven wedge tightening system instead of clamp bolts. Power tubing clamp 40 consists of right-hand gripper 41, left-hand gripper 51, a hinge shaft 58 with hinge nuts 60, two Belleville spring washers 61, an operator cylinder support 64, an operator cylinder assembly 69, and wedge block 80.

Right-hand gripper 41 has a flat vertical interior face with a vertical axis circularly arcuate groove, which serves as a tubing gripping, face 42 positioned in the central portion of the vertical interior face. The axis of the arcuate groove is spaced slightly away from and outside the vertical interior face so that the arc of the vertical arcuate groove is less than 180°, and the diameter of the gripping face 42 corresponds to that of the tubing 90 with which the gripper will be used. At one side of the vertical interior face two spaced apart hinge eyes 43*a,b* are formed, with eye 43*a* at the top and eye 43*b* just below midheight. Hinge eyes 43*a,b* are short cylindrical elements with coaxial vertical axes which are spaced slightly away from and outside the flat vertical interior face. The outer cylindrical faces of hinge eyes 43*a,b* are tangent to the exterior vertical face of right-hand gripper 41. The wall thickness of right-hand gripper 41 is thickened adjacent tubing gripping face 42 to support high bending stresses in that region. Vertical hinge bolt hole 44 is bored coaxially with the hinge eyes 43*a,b* and passes through both those eyes. Clamping ear 45 is formed on the opposite side of right-hand gripper 41 from the hinge eyes 43*a,b*. The horizontal top and bottom surfaces and the outer transverse side of clamping ear 45 are flat. The wedging outer surface 46 of clamping ear 45 is obverse to the vertical interior face and is flat and inclined from the vertical by an angle of approximately 6.5° so that the thickness of clamping ear 45 decreases downwardly. The taper angle of wedging outer surface 46 is chosen to be a "non-slipping angle". A wedge with such an angle has the property that due to friction it will not slip when the wedge is under transverse load without the application of sufficient external force substantially parallel to the wedging surfaces. Located on wedging outer surface 46 parallel to and spaced away from the outer transverse side of clamping ear 45 is a rectangular guide groove of constant cross-section.

Left-hand gripper 51 is in several respects similar to right-hand gripper 41. Left-hand gripper 51 has a flat vertical interior face with a vertical axis circularly arcuate groove, which serves as a tubing gripping, face 52 positioned in the central portion of its vertical interior face. The axis of the arcuate groove 52 is spaced slightly away from and outside the vertical interior face so that the arc of the vertical arcuate groove is less than 180°, and the diameter of the gripping face 52 corresponds to that of the tubing with which the gripper will be used. At one side of the vertical interior face two spaced apart hinge eyes 53*a,b* are formed, with eye 53*b* at the bottom and eye 53*b* just below midheight. Hinge eyes 53*a,b* are short cylindrical elements with coaxial vertical axes which arc spaced slightly away from and outside the flat vertical interior face. The outer cylindrical faces of hinge eyes 53*a,b* are tangent to the exterior vertical face of left-hand gripper 51. The wall thickness of left-hand gripper 51 is thickened adjacent tubing gripping face 52 to support high bending stresses in that region. Vertical hinge bolt hole 44 is bored coaxially with the hinge eyes 53*a,b* and passes through both those eyes. Clamping ear 55 is formed on the opposite side of left-hand gripper 51 from the hinge eyes 53*a,b* and has its outer face parallel to the vertical interior face. The horizontal top and bottom surfaces and the outer transverse side of clamping ear 55 are flat. The wedging outer surface 56 of clamping ear 55 is obverse to the vertical interior face and is flat and inclined from the vertical by the same angle as that of wedging outer surface 46 of right-hand gripper 41 so that the thickness of clamping ear 55 decreases downwardly. Located on wedging outer surface 56 parallel to and spaced away from the outer transverse side of clamping ear 55 is a rectangular guide groove of constant cross-section. Two shallow, flat-bottomed circular spring pockets 57 are located symmetrically about the horizontal midplane of left-hand gripper 51 on the vertical interior face of clamping ear 55.

Left-band gripper 51 has its hinge eyes 53*a,b* coaxial with the hinge eyes 43*a,b* of right-hand gripper 41 and is mounted so that the wedging outer surfaces 46 and 56 of the grippers both taper downwardly. The length and position of hinge eyes 43*a,b* and 53*a,b* are such that they intermesh closely when right-hand gripper 41 and left-hand gripper 51 are positioned together. Hinge shaft 58 is a long cylindrical round shaft with male threads at both ends and a coaxial cylindrical intermediate shaft upset section 59 with transverse upper and lower sides located nearly at the upper end of the shaft. Hinge shaft 58 has a close sliding fit into the hinge bolt hole 44 and serves as a pivot and mounting shaft for the right-hand and left-hand grippers. The lower transverse side of intermediate shaft upset 59 bears on the upper transverse face of hinge eye 43*a*. Hinge shaft 58 is made sufficiently long so that it can be inserted through a supporting base for the power tubing clamp 40 and thereby support the clamp. Internally threaded clamp nuts 60 are mounted on the top and bottom threaded portions of hinge shaft 58 to cause the components of the clamp assembly to fit closely to themselves and to their mounting base. In particular, the hinge eyes 43*a,b* and 53*a,b* interleave with a close fit to minimize axial play of the grippers on hinge shaft 58. A Belleville spring washer 61 is fined within each of the spring pockets 57 of clamp ear 55 so that it protrudes beyond the vertical interior face of left-hand gripper when uncompressed. The Belleville spring protrusion beyond the vertical interior face is such that the spring exerts substantial force on clamping car 45 of right-hand gripper 41 when the tubing is tightly gripped by power tubing clamp 40.

Operator cylinder support 64 is a steel plate approximately two inches thick and having a lozenge shape with rounded corners. Threaded cylinder mount hole 65 is located at the first end of operator cylinder support 64, tubing clearance hole 66 is located in the middle, and hinge shaft hole 67 is at the second end. Tubing clearance hole 66 is fairly large to provide ample clearance for passage of tubing through the power tubing clamp 40. Hinge shaft hole 67 is a close fit to hinge shaft 58. Operator cylinder support 64 is positioned horizontally with the upper end of hinge shaft 58 through hinge shaft hole 67 and the lower face of support 64 bearing on the upper transverse shoulder of intermediate shaft upset 59 of hinge shaft 58. A hinge shaft nut 60 is torqued down onto the upper threads of hinge shaft 58 on the upper side of operator cylinder support 64 to firmly clamp the support to the hinge shaft 58.

Double-acting operator hydraulic cylinder assembly 69 consists of cylinder body 70, piston 71, and rod 72, along with associated elbow fittings 73 and hydraulic tubing 74. Cylinder body 70 is of conventional tubular construction with a cylindrical male threaded front nose mount, an elastomeric rod seal in the front nose, and both a rod extension and a rod retraction port at opposed ends of the cylinder interior. Piston 71 is a short circular cylindrical disk with an annular elastomeric seal in its annular groove and integral cylindrical rod 72 attached to its lower side. The lower end of rod 72 is provided with a conventional wrench flat and male threads. The threaded front nose of the cylinder assembly 69 is screwed into the threaded cylinder mount hole 65 of operator cylinder support 64. A hydraulic elbow fitting 73 is screwed into each of the ports of cylinder assembly 69, and hydraulic tubing 74 is sealingly attached to the elbow fitting by the conventional compression nut of the fitting. Hydraulic pressure from a conventional hydraulic power system is applied by means of a selectably controlled hydraulic valve to one or the other hydraulic tubing 74 and thence to the operator hydraulic cylinder assembly 69. This hydraulic power system is not shown herein, but is well understood by those skilled in the art.

Wedge block 80 is a rectangular block approximately 12 inches high by 7 inches wide and 3 inches thick. Wedge cavity 81, located on one of the largest faces of wedge block 80, has a constant depth trapezoidal shape symmetrical about the vertical perpendicular midplane of that face of the block. Wedge cavity 81 decreases in width downwardly with side tapers matching those of the wedging outer surfaces 46 and 56 of, respectively, right-hand gripper 41 and left-hand gripper 51. On each tapered side of wedge cavity 81 is rectangular cross-section retainer land 82 parallel to and spaced apart from the face of wedge block 80 which contains wedge cavity 81. Retainer lands 82 of wedge block 80 comate and interact with the rectangular guide grooves in the clamping outer faces 46 and 56 of, respectively, right-hand gripper 41 and left-hand gripper 51 when these elements are assembled so that the clamping ears 45 and 55 of the grippers are positioned in wedge cavity 81. Retainer lands 82 thus retain and provide guidance to wedge block 80. In the middle of the upper transverse face of wedge block 80 is a female threaded blind hole which has threads which are comated with the rod end threads of the rod 72 of operator cylinder assembly 69 so that wedge block 80 can be reciprocated vertically. Approximately round coiled tubing 90 may be deployed within the arcuate tubing gripping faces 42 and 52.

Another embodiment of the thrust enhancement device for coiled tubing injectors, shown in FIGS. 10 through 13, is based upon the powered tubing clamp 40, shown in FIGS. 5–9 and 16. Remotely controlled thrust enhancement device 1 consists of a structural tube body 2, multiple hydraulic thrust cylinders 20, a moveable transverse deck 30, and two powered tubing clamps 40. Square structural tube body 2 is a commercially available steel section which is approximately 18 inches by 18 inches square and with 0.625 inch wall thickness by 61.25 inches long. The corners of the tube are radiused due to its manner of fabrication. Identical bottom 3 and top transverse flanges 4 are made of plate steel cut into a hollow square pattern and welded to the tubular body 2. Transverse through mounting holes are provided on the outer corners of each of the flanges 3 and 4 to facilitate mounting the thrust enhancement device to the blowout preventers of the coiled tubing rig and/or the separate conventional coiled tubing injector system. Rectangular windows with rounded corners to provide reductions of stress concentrations are cut into each of the side walls of tubular body 2 to provide access and visibility for the tubing and the other hardware mounted therein. The four upper windows 8 are identical, approximately square cutouts with each positioned symmetrically about the centerline of its respective face of body 2 close to the top transverse flange 4. The four lower windows 9 are identical and higher than they are wide. The lower windows are each positioned symmetrically about the centerline of their respective faces of body 2 close to the bottom transverse flange 3.

Static transverse deck 12 is a horizontal square piece of plate approximately 2 inches thick with radiused corners on the vertical corners of the square to closely fit inside tubular body 2. Static transverse deck 12 is welded into place inside tubular body 2 normal to the through axis of the body between the upper windows 8 and the lower windows 9. A round through hole for powered tubing clamp mounting 13 is positioned on a first vertical midplane but offset to one side of the second, transverse vertical midplane of static transverse deck 12. The through hole for powered tubing clamp mounting 13 provides a snug fit to the lower end of clamp hinge shaft 58, which is mounted in the hole and retained by a hinge shaft nut 60 on the lower side of static transverse deck 12. The offset of through hole 13 from the second vertical midplane is chosen so that the tubing 90 will be on the vertical centerline axis of body 2 when held by a powered tubing clamp 40 mounted by means of hole 13. A rectangular through hole for tubing clearance 14 with rounded corners is symmetrical about the first vertical midplane but offset to the opposite side of the other, second transverse vertical midplane of static transverse deck 12 from through hole 13 for powered tubing clamp mounting. The through hole for tubing clearance 14 permits the tubing to pass through thrust enhancement device 1 on the vertical centerline of body 2. Tubing clearance hole 14 is oversized to also permit ample clearance for downward unlatching movement of the wedge block 80 of powered tubing clamp 40. Additionally, static transverse deck 12 also has a doubly symmetric pattern of four female threaded blind holes 15 on its lower side for attachment of the rod ends of hydraulic thrust cylinders 20.

Hydraulic thrust cylinder 20 is a conventional double-acting cylinder with a single rod and a coaxial rear bolt mounting. Although the individual parts of the hydraulic thrust cylinder are not shown, it has a conventional construction and is well known in the art. Cylinder body has a rod gland with an elastomeric rod seal on its upper end with a coaxial female threaded mounting hole on the lower transverse blind end of the cylinder. Cylinder body has a radial rod return port near its upper end and a radial rod extend port near its lower end. Cylinder piston is a short circular cylindrical disk with an annular elastomeric seal in its annular groove and integral cylindrical cylinder rod 25 attached to its upper side. The upper end of rod 25 is provided with a conventional wrench flat and male threads which are comated with the female threads of the threaded blind holes for cylinder rod attachment 15 located on the bottom side of static transverse deck 12 of body 2. Hex-headed cylinder mounting screw 28 comates with the female thread on the bottom side of cylinder body to mount the cylinder 20 to moveable transverse deck 30. An elbow hydraulic fitting is screwed into each of the ports of the thrust cylinder, and hydraulic tubing is sealingly attached to the elbow fitting by the conventional compression nut of the fitting. Hydraulic pressure from a conventional hydraulic power system is applied by means of a selectably controlled hydraulic valve to one or the other hydraulic tubing and thence to the hydraulic thrust cylinder. This hydraulic power system is not shown herein, but is well understood by those skilled in the art. Four identical hydraulic thrust cylinders 20 are used in a doubly symmetrical mounting pattern when viewed in plan view to provide direct thrust loading without attendant bending to the tubing.

Moveable transverse deck 30 is a horizontal square piece of plate approximately 3 inches thick having large chamfers on the vertical corners of the square for clearance to fit inside tubular body 2. Moveable transverse deck 30 is sized to be a close slip fit within tubular body 2 when it is reciprocated along the axis of the body. Moveable transverse deck 30 has the same pattern for its four through holes for cylinder mounting 33 as is used for the threaded blind holes for cylinder rod attachments 15 on the static transverse deck 12 of tubular body 2. Likewise, the pattern for its through hole for powered tubing clamp mounting 32 and its through hole for tubing clearance 33 are the same as the corresponding holes 13 and 14 of static transverse deck 12 of tubular body 2. Moveable transverse deck 30 is installed below static transverse deck 12 with its clamp mounting hole 32 coaxial with that of clamp mounting hole 13 of static transverse deck 12. The bottom end of each of the four cylinders 20 is clamped to the top surface of moveable transverse deck 30 by means of cylinder mounting screws 28 engaged in through holes for cylinder mounting bolts 34 and the female threaded holes on the bottom end of cylinders 20.

One powered tubing clamp 40 (described previously) is mounted on the upper surface of static transverse deck 12 by means of its hinge shaft 58 and a hinge shaft nut 60 coaxial with through hole 13 in the static transverse deck of body 2. The vertical plane of symmetry of tubing clamp 40 is coplanar with the aforementioned first vertical plane of symmetry of the static transverse deck 12 of body 2. A second powered tubing clamp 40 is mounted on the upper surface of moveable transverse deck 30 by means of its hinge shaft 58 and a hinge shaft nut 60 coaxial with through hole 32 in the moveable transverse deck 30. The vertical plane of symmetry of tubing clamp 40 is coplanar with the aforementioned first vertical plane of symmetry of the moveable transverse deck 30.

Figure 14:
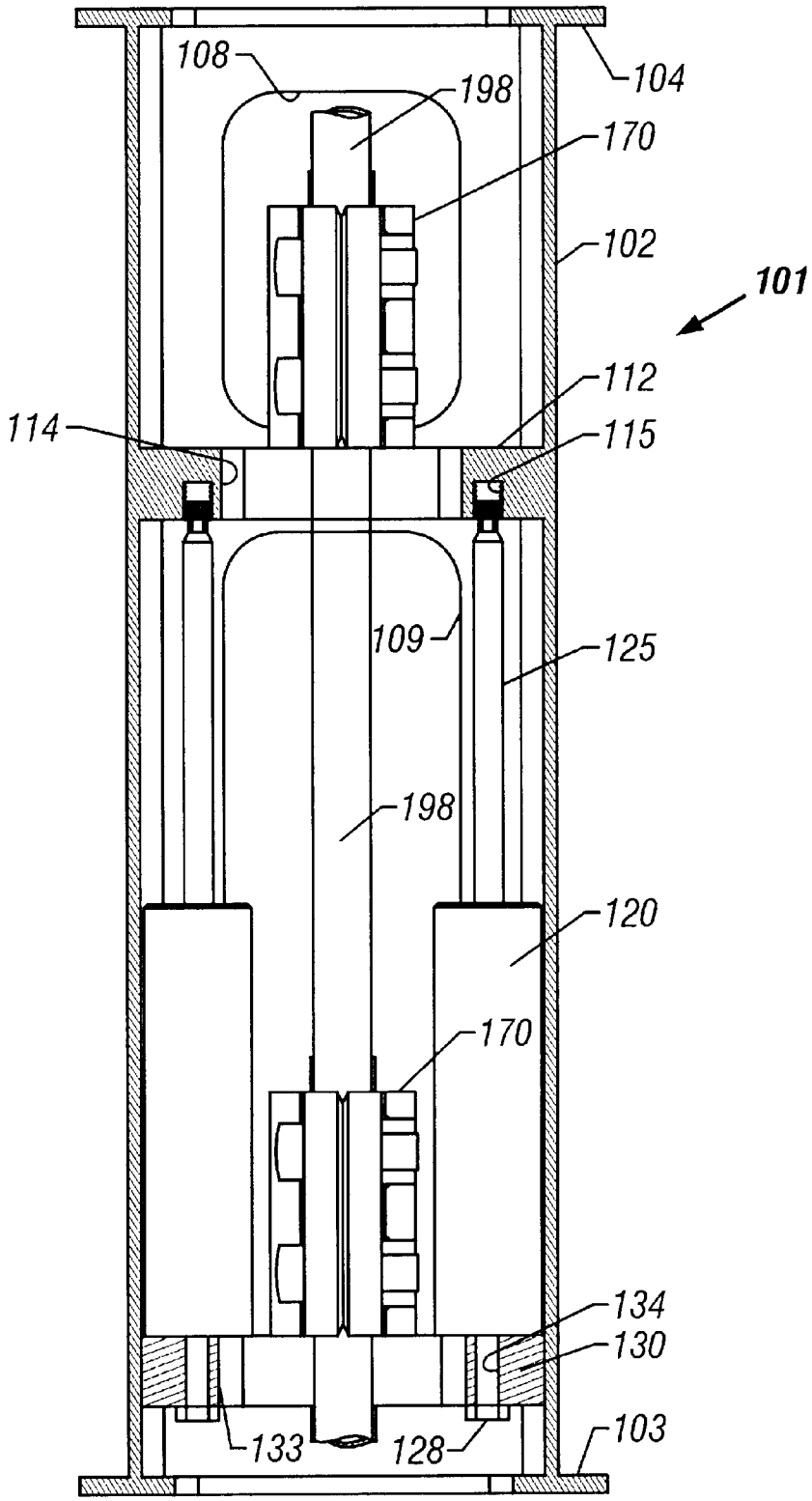
FIG. 14 is a vertical transverse partially sectioned view of another embodiment of the thrust enhancement device, which utilizes the manual clamp of FIG. 1, in a first operational position.
Figure 15:
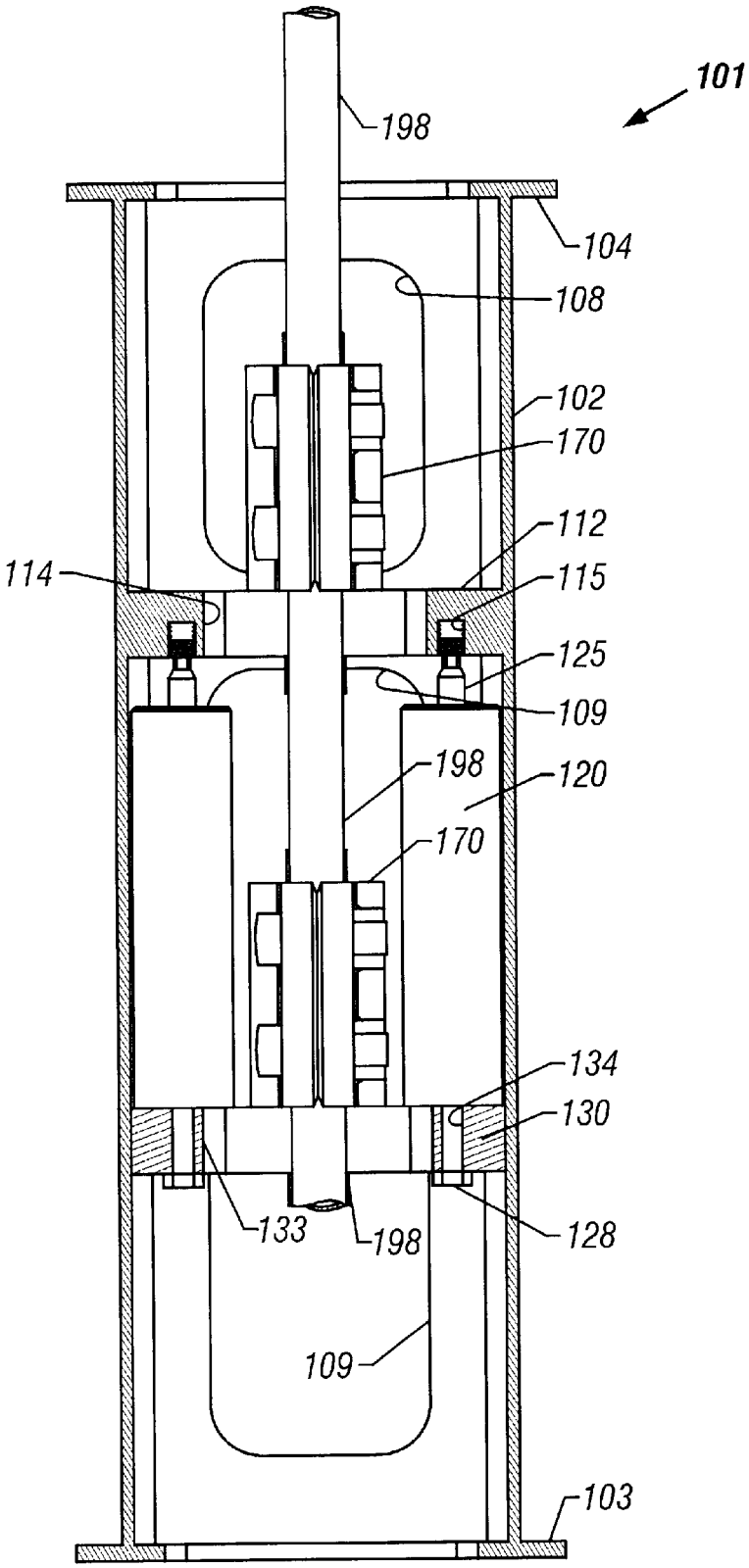
FIG. 15 is a vertical transverse partially sectioned view of the embodiment of the thrust enhancement device corresponding to that of FIG. 14, but with the device in its second operational position.
Figure 16:
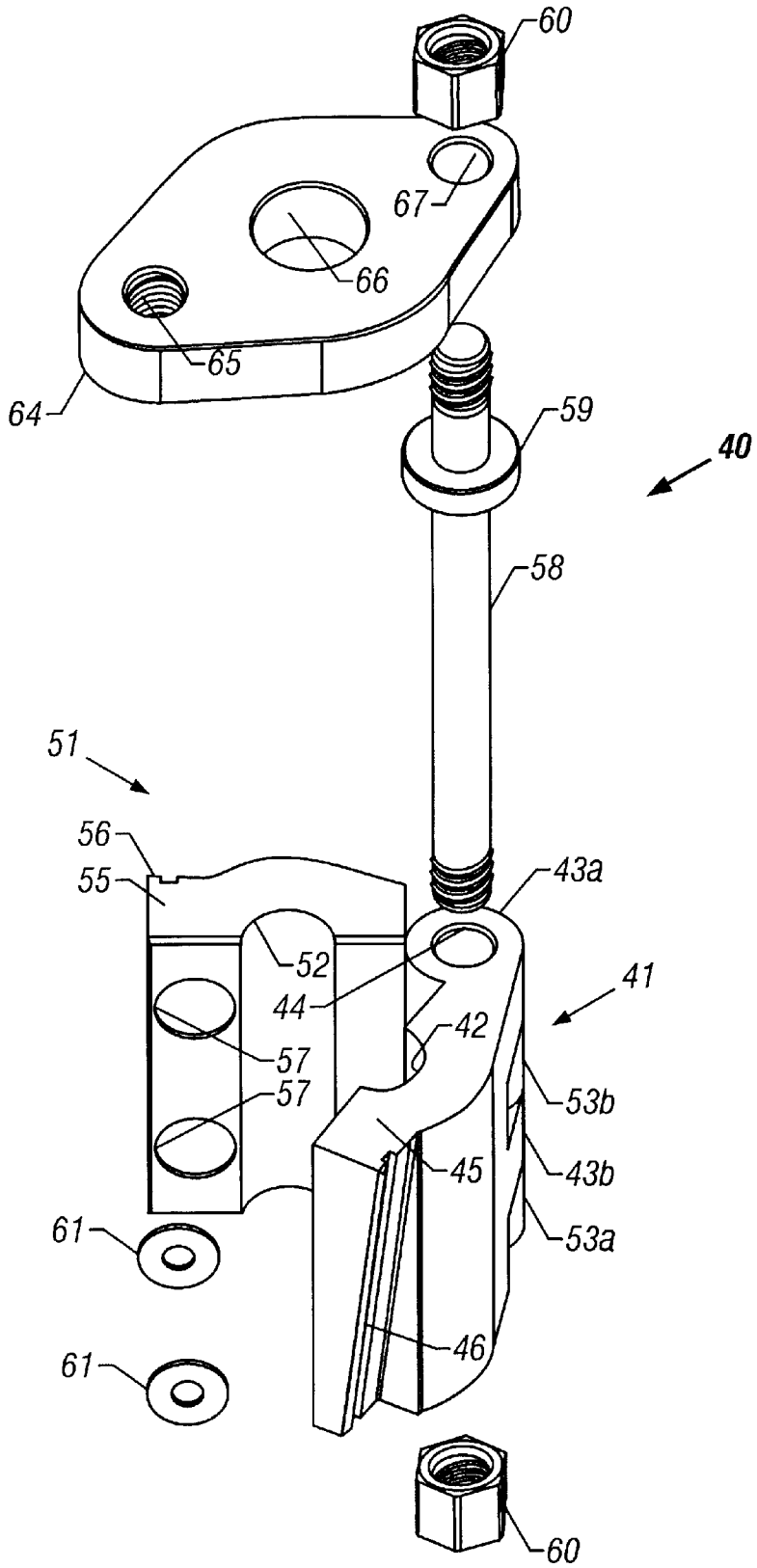
FIG. 16 is an exploded oblique view of the gripping elements of the hydraulically operated powered tubing clamp of FIG. 5.

Another embodiment of the thrust enhancement device for coiled tubing injectors, shown in FIGS. 14 and 15, is based upon the manual tubing clamp 170, shown in FIGS. 1–4. Manually controlled thrust enhancement device 101 consists of a structural tube body 102, multiple hydraulic thrust cylinders 120, a moveable transverse deck 130, and two manual tubing clamps 170. With the exception of the types of tubing clamps used, the manually controlled 101 and remotely controlled 1 thrust enhancement devices are identical. The part numbers 2 through 34 of thrust enhancer device 1 correspond to part numbers 101–134 of thrust enhancement device 101 and arc not necessarily discussed individually herein.

Square structural tube body 102 is a commercially available steel section which is approximately 18 inches by 18 inches square and with 0.625 inch wall thickness by 61.25 inches long. The corners of the tube are radiused due to its manner of fabrication. Identical bottom 103 and top transverse flanges 104 are made of plate steel cut into a hollow square pattern and welded to the tubular body 102. Transverse through mounting holes are provided on the outer corners of each of the flanges 103 and 104 to facilitate mounting the thrust enhancement device to the blowout preventers of the coiled tubing rig and/or the separate conventional coiled tubing injector system. Rectangular windows with rounded corners to provide reductions of stress concentrations are cut into each of the side walls of tubular body 102 to provide access and visibility for the tubing and the other hardware mounted therein. The four upper windows 108 are identical, approximately square cutouts with each positioned symmetrically about the centerline of its respective face of body 102 close to the top transverse flange 104. The four lower windows 109 are identical and higher than they are wide. The lower windows are each positioned symmetrically about the centerline of their respective faces of body 102 close to the bottom transverse flange 103.

Static transverse deck 112 is a horizontal square piece of plate approximately 2 inches thick with radiused corners on the vertical corners of the square to closely fit inside tubular body 102. Static transverse deck 112 is welded into place inside tubular body 102 normal to the through axis of the body between the upper windows 108 and the lower windows 109. A round through hole for manual tubing clamp mounting 113 is positioned on a first vertical midplane but offset to one side of the second, transverse vertical midplane of static transverse deck 112. The through hole for powered tubing clamp mounting 113 provides a snug fit to the lower end of clamp hinge shaft 188, which is mounted in the hole and retained by a hinge shaft nut 189 on the lower side of static transverse deck 112. The offset of through hole 113 from the second vertical midplane is chosen so that the tubing 198 will be on the vertical centerline axis of body 102 when held by a manual tubing clamp 170 mounted by means of hole 113. A rectangular through hole for tubing clearance 114 with rounded corners is symmetrical about the first vertical midplane but offset to the opposite side of the other, second transverse vertical midplane of static transverse deck 112 from through hole 113 for manual tubing clamp mounting. The through hole for tubing clearance 114 permits the tubing 198 to pass through thrust enhancement device 101 on the vertical centerline of body 102. Additionally, static transverse deck 112 also has a doubly symmetric pattern of four female threaded blind holes 115 on its lower side for attachment of the rod ends of hydraulic thrust cylinders 120.

Hydraulic thrust cylinder 120 is a conventional double-acting cylinder with a single rod and a coaxial rear bolt mounting. Cylinder body 121 has a rod gland with an elastomeric rod seal on its upper end with a coaxial female threaded mounting hole on the lower transverse blind end of the cylinder. Cylinder body 121 has a radial rod return port 122 near its upper end and a radial rod extend port 123 near its lower end. Cylinder piston 124, which is not shown but is of conventional construction, is a short circular cylindrical disk with an annular elastomeric seal in its annular groove and integral cylindrical cylinder rod 125 attached to its upper side. The upper end of rod 125 is provided with a conventional wrench flat and male threads which are comated with the female threads of the threaded blind holes for cylinder rod attachment 115 located on the bottom side of static transverse deck 112 of body 102. Hex-headed cylinder mounting screw 128 comates with the female thread on the bottom side of cylinder body 121 to mount the cylinder 120 to moveable transverse deck 130. An elbow hydraulic fitting 126 is screwed into each of the ports 122 and 123 of thrust cylinder 120, and hydraulic tubing 127 is sealingly attached to the elbow fitting by the conventional compression nut of the fitting. Hydraulic pressure from a conventional hydraulic power system is applied by means of a selectably controlled hydraulic valve to one or the other hydraulic tubing 127 and thence to the hydraulic thrust cylinder 120. This hydraulic power system is not shown herein, but is well understood by those skilled in the art. Four identical hydraulic thrust cylinders 120 are used in a doubly symmetrical mounting pattern when viewed in plan view to provide direct thrust loading without attendant bending to the tubing.

Moveable transverse deck 130 is a horizontal square piece of plate approximately 3 inches thick having large chamfers on the vertical corners of the square for clearance to fit inside tubular body 12. Moveable transverse deck 130 is sized to be a close slip fit within tubular body 102 when it is reciprocated along the axis of die body. Moveable transverse deck 130 has the same pattern for its four through holes for cylinder mounting 133 as is used for the threaded blind holes for cylinder rod attachments 115 on the static transverse deck 112 of tubular body 102. Likewise, the pattern for its through hole for powered tubing clamp mounting 132 and its through hole for tubing clearance 133 are the same as the corresponding holes 113 and 114 of static transverse deck 112 of tubular body 102. Moveable transverse deck 130 is installed below static transverse deck 112 with its clamp mounting hole 132 coaxial with that of clamp mounting hole 113 of static transverse deck 112. The bottom end of each of the four cylinders 120 is clamped to the top surface of moveable transverse deck 130 by means of cylinder mounting screws 128 engaged in through holes for cylinder mounting bolts 134 and the female threaded holes on the bottom end of cylinders 120.

One manual tubing clamp 170 (described previously) is mounted on the upper surface of static transverse deck 112 by means of its hinge shaft 188 and a hinge shaft nut 189 coaxial with through hole 113 in the static transverse deck of body 102. The vertical plane of symmetry of tubing clamp 170 is coplanar with the aforementioned first vertical plane of symmetry of the static transverse deck 112 of body 102. A second manual tubing clamp 170 is mounted on the upper surface of moveable transverse deck 130 by means of its hinge shaft 188 and a hinge shaft nut 189 coaxial with through hole 132 in the moveable transverse deck 130. The vertical plane of symmetry of tubing clamp 170 is coplanar with the aforementioned first vertical plane of symmetry of the moveable transverse deck 130.

Figure 17:
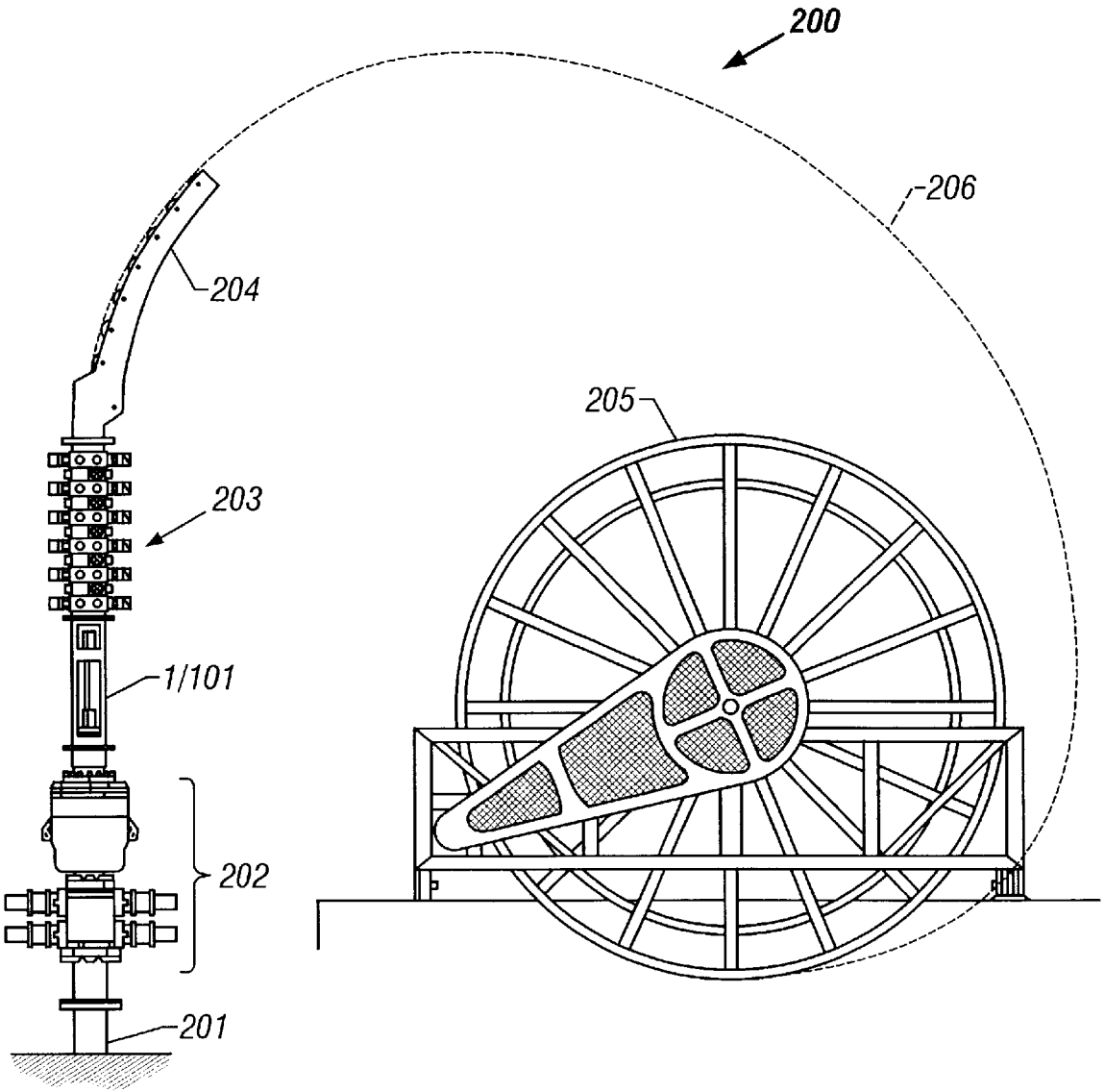
FIG. 17 is a side profile view of the thrust enhancement device of this invention showing its relationship with the other elements of a coiled tubing injection system.

FIG. 17 shows the relationship of the thrust enhancement device of this invention to the other components of a coiled tubing injection system and a typical onshore wellhead of a well used for the production of petroleum products. The rigged up coiled tubing rig 200 on the wellhead 201 consists of the blowout preventors 202, the thrust enhancement device 1 or 101, the coiled tubing injector 203, the gooseneck 204, the storage reel 205, and the coiled tubing 206. Wellhead 201 is attached to the top end of the outer, initial casing of a well and provides physical support and flow isolation for the other various casing strings and tubing of the well, as well as valving and fluid connections for hooking the well up to the surface facilities for the well. The blowout preventors 202 for the coiled tubing rig are a modular assembly which can either seal on the exterior of the coiled tubing 206 or shear it and then seal across the upward looking end of the sheared coiled tubing. The blowout preventors 202 arc attached to the flange on the top of the wellhead by a similar, comating flange on the bottom of the blowout preventor assembly. A flange at the top of the blowout preventor assembly is attached to either the bottom flange 3 of the remotely controlled thrust enhancement device 1 or the bottom flange 103 of the manually controlled thrust enhancement device 101, depending on which embodiment of the invention is used. A coiled tubing injector 203 is attached to either the top flange 4 of thrust enhancement device 1 or the top flange 104 of thrust enhancement device 101, as appropriate. The coiled tubing injector 203 could be any one of a variety of designs, including that shown in copending U.S. Provisional Patent Application "Coiled Tubing Injector Utilizing Opposed Drive Modules and Having an Integral Bender", filed Jul. 11, 2001, a conventional opposed track type, or a single-side track type with hold-down rollers. A gooseneck 204 of conventional construction is mounted on the top of injector 203. The tubing 206 is stored on reel 205 and passes from the reel, over the gooseneck 204, through the injector 203, through the thrust enhancement device (1 or 101), and into the wellhead 201 and, thence, the well. These coiled tubing rig components are standard equipment items well known in the oilfield industry.

Operation of the Invention

The operation of both of the clamps 40 and 170 and of the thrust enhancement device embodiments 1 and 101 described herein is simple and straightforward. The thrust enhancement device embodiments are used in conjunction with the other hardware of a typical coiled tubing rig as shown in FIG. 17. As may understood by those familiar with this equipment the thrust enhancement device could be positioned between the injector and the gooseneck, rather than as shown in FIG. 17. Likewise, the thrust enhancement device could be used with a wheel type injector, rather than a single or double tracked injector or the device of the aforementioned copending injector.

Figure 4:
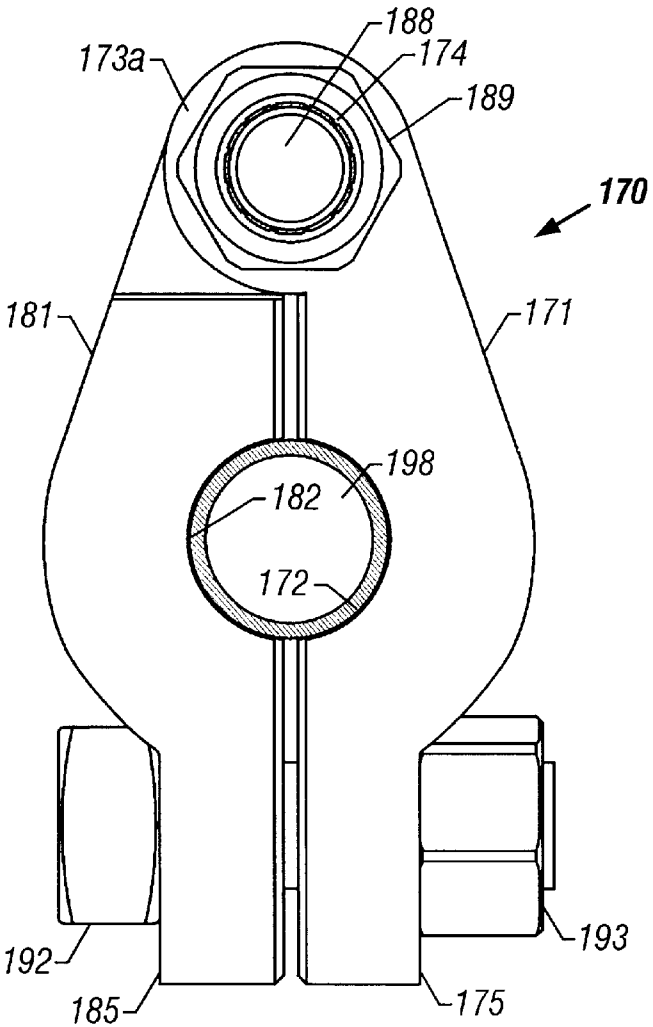
FIG. 4 is a plan view corresponding to that of FIG. 3, but with the clamp closed and gripping the tubing.
Figure 3:
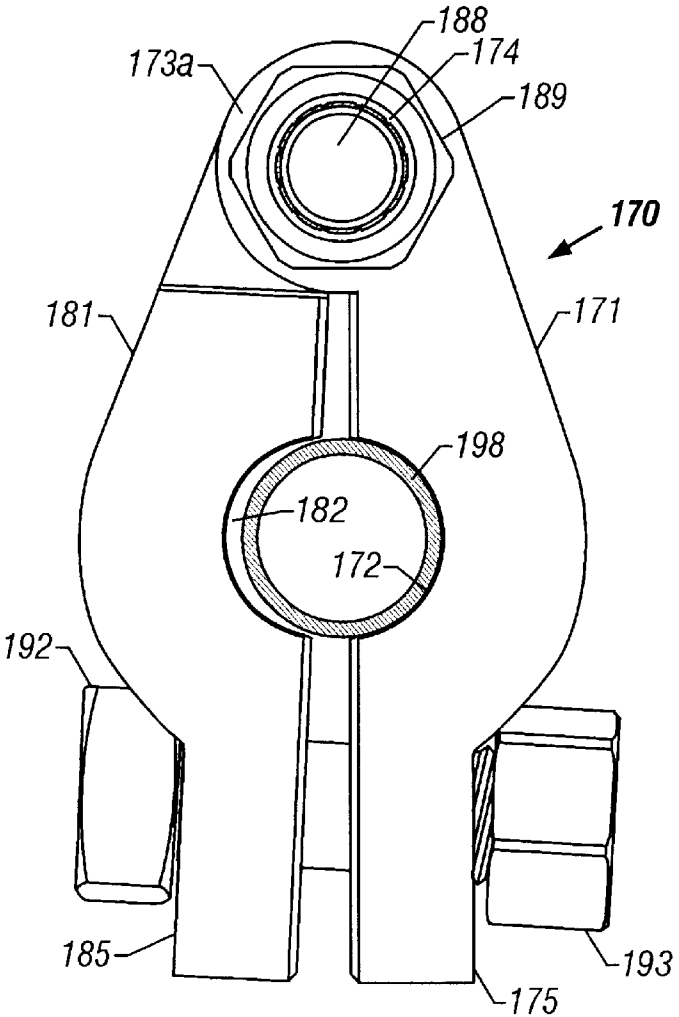
FIG. 3 is a plan view of the clamp of FIG. 1 showing the clamp in open position, but with a section of tubing within its throat.
Figure 5:
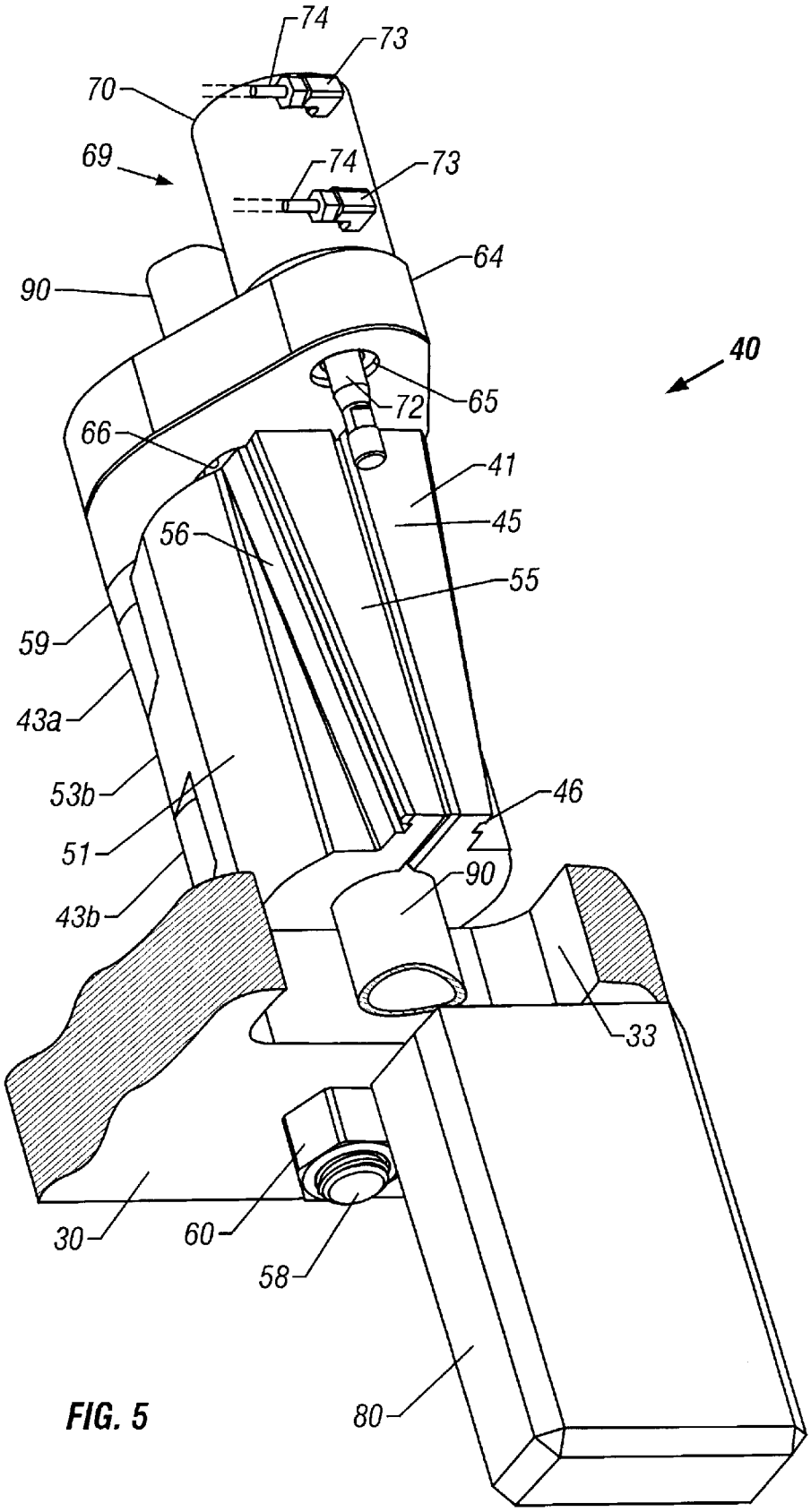
FIG. 5 is an oblique view of a hydraulically operated powered tubing clamp mounted to a support surface, and having a closing latch wedge shifted downwardly along its axis of travel.

The operation of manual tubing clamp 170 is best understood from referring to FIGS. 3 and 4. In FIG. 3, manual tubing clamp 170 is shown with the right-hand gripper 171 and the left-hand gripper 181 pivoted relative to each other about hinge shaft 188 to the open position of the clamp. This opening is possible because a manually operated wrench (not shown) has been used to loosen clamp nuts 193 so the clamp halves can separate and normally will not grip the tubing tightly. The position of the clamp 170 corresponds to the position, which is required for initially passing the tubing through the axis of the manually controlled thrust enhancement device 101. This same position is used for both manual clamps in a manually controlled thrust enhancement device. In the event that the tubing binds in the grooves 172 and 182 of the grippers 171 and 181, a prying device can be used to separate the grippers and a hammer or other suitable device can be used to separate a binding gripper from the tubing. This operation is not problematic, since generally only very short axial travels of the tubing equivalent to a very small number of thrust enhancement device strokes are required to overcome and excessive resistance to tubing injection which might necessitate use of the devices of this invention. The manual tubing clamp 170 is caused to grip the tubing by tightening the clamp nuts 193 manually with a wrench until the torque applied is sufficient to cause the gripper 171 and 181 to tightly hold the tubing 198. The heads of clamp bolts 192 are restrained from rotating during the torqueing of clamp nuts 193 by the inboard vertical edges of the extensions of the external flat transverse face of clamping ear 185.

Figure 6:
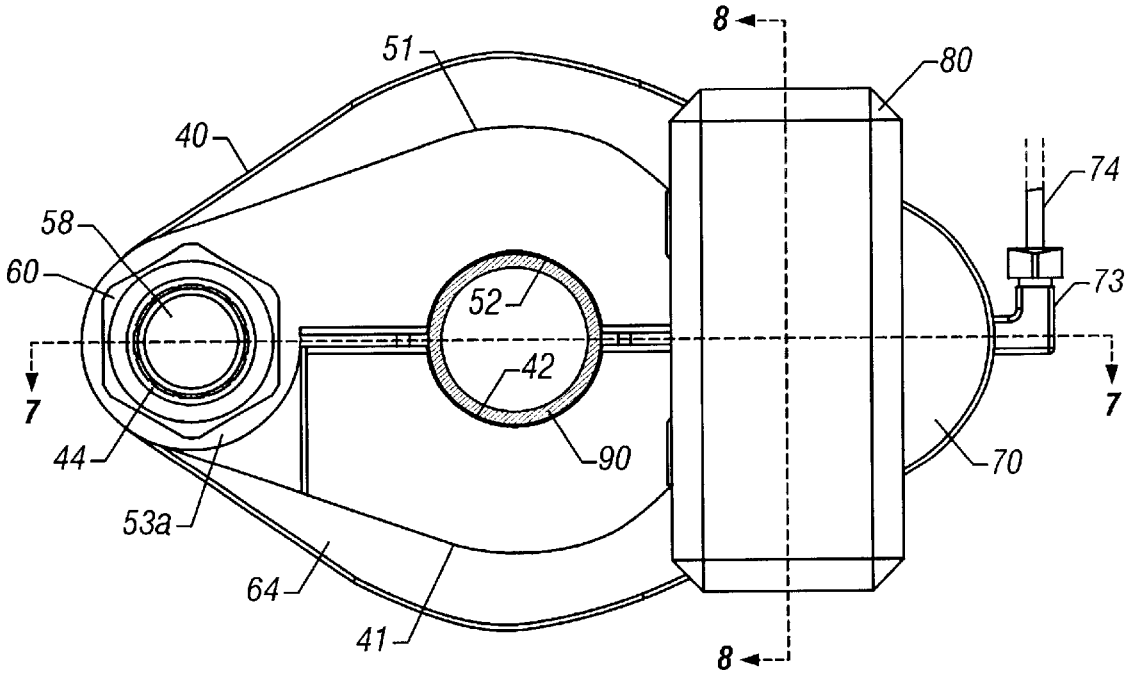
FIG. 6 is a bottom view of the hydraulically operated powered tubing clamp of FIG. 5 clamped on a section of tubing within its throat.
Figure 9:
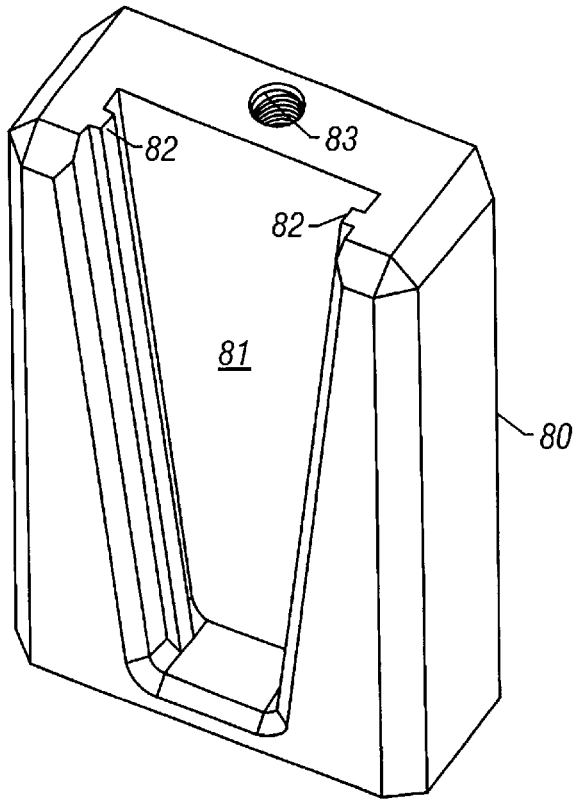
FIG. 9 is an oblique view showing the wedging closure block used with the hydraulic clamp of FIG. 5.
Figure 7:
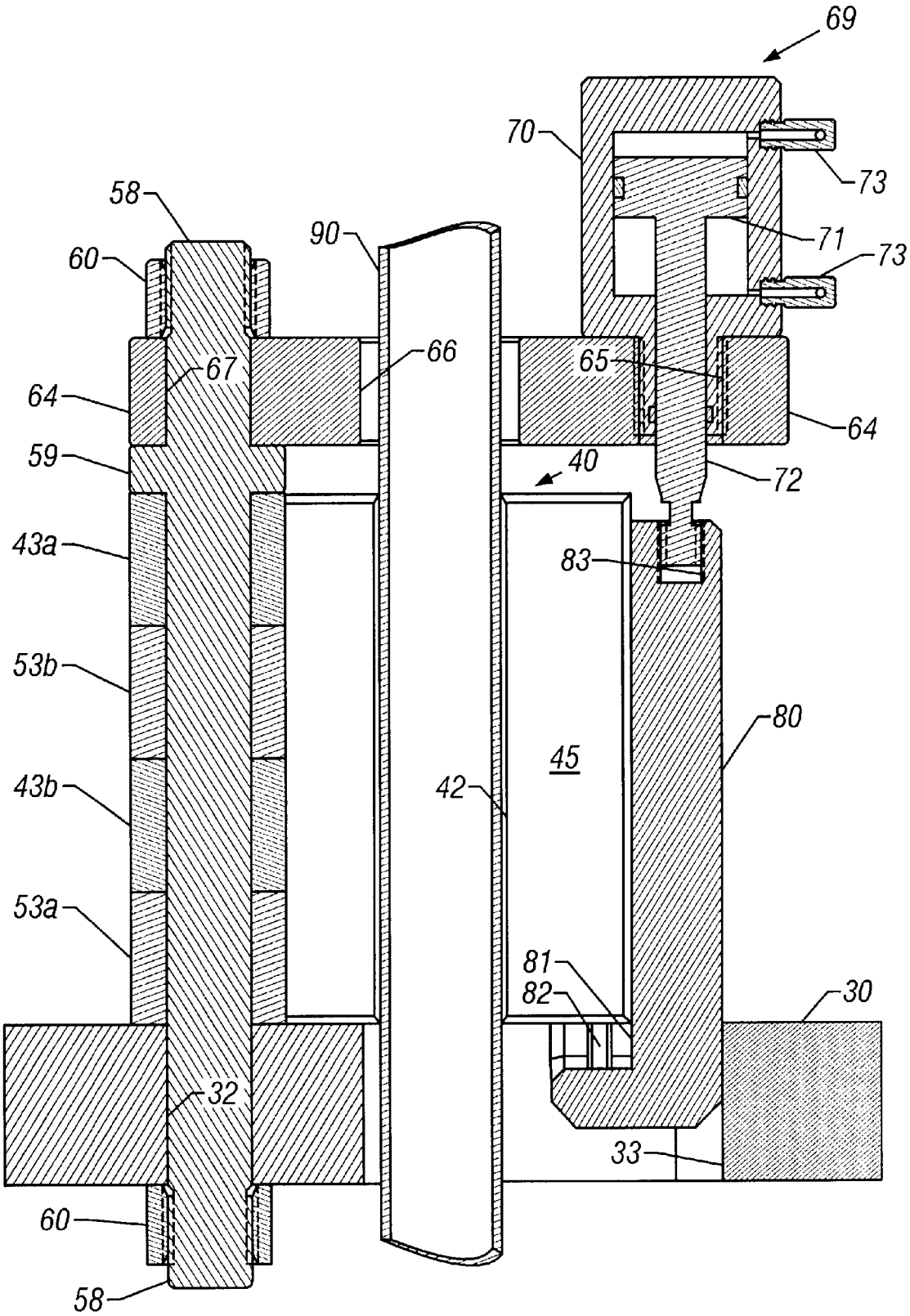
FIG. 7 is a longitudinal vertical sectional view of the closed hydraulically operated powered tubing clamp of FIG. 5.
Figure 8:
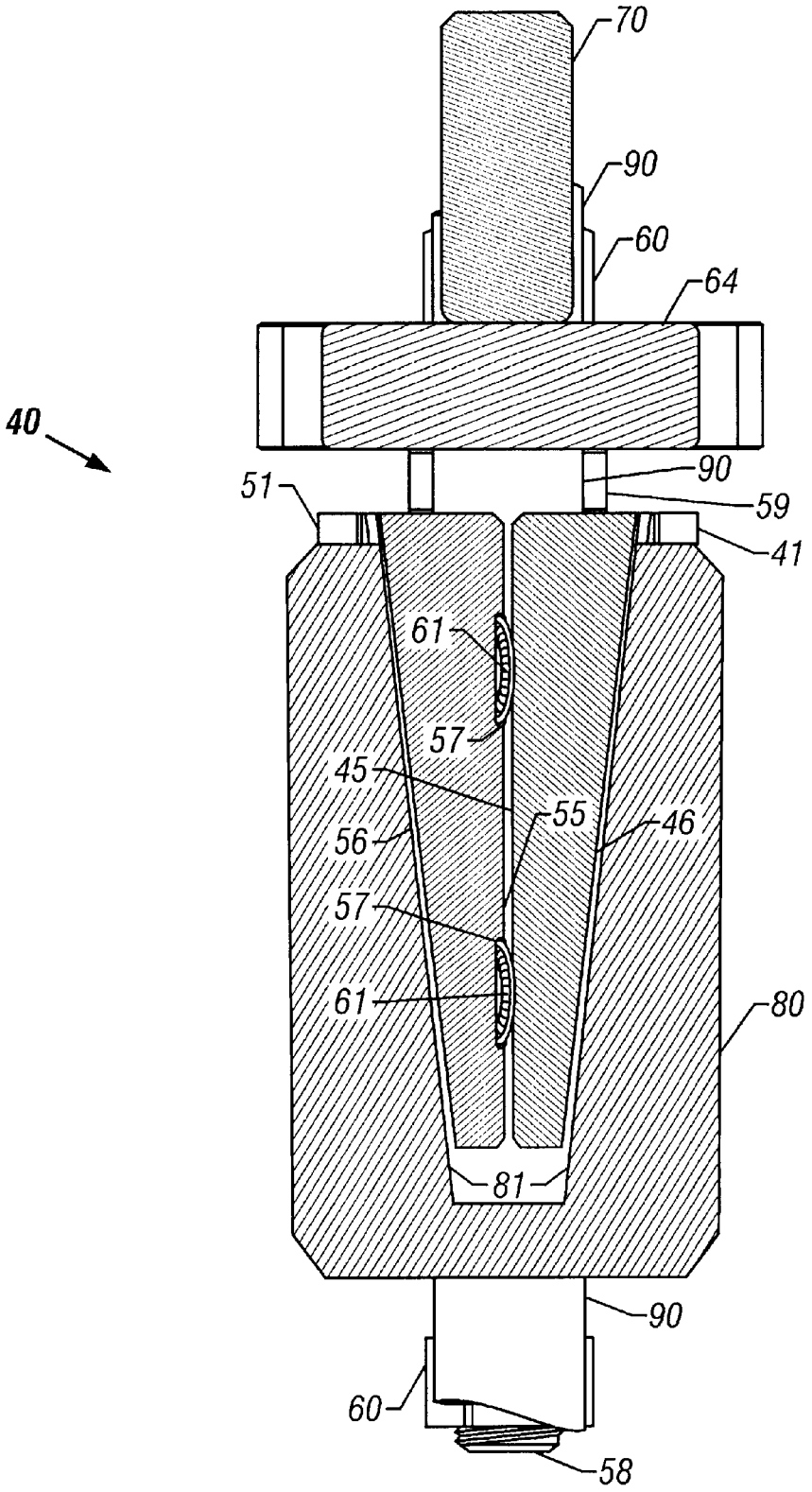
FIG. 8 is a transverse vertical sectional view of the wedging mechanism of the closed hydraulic clamp of FIG. 7.
Figure 10:
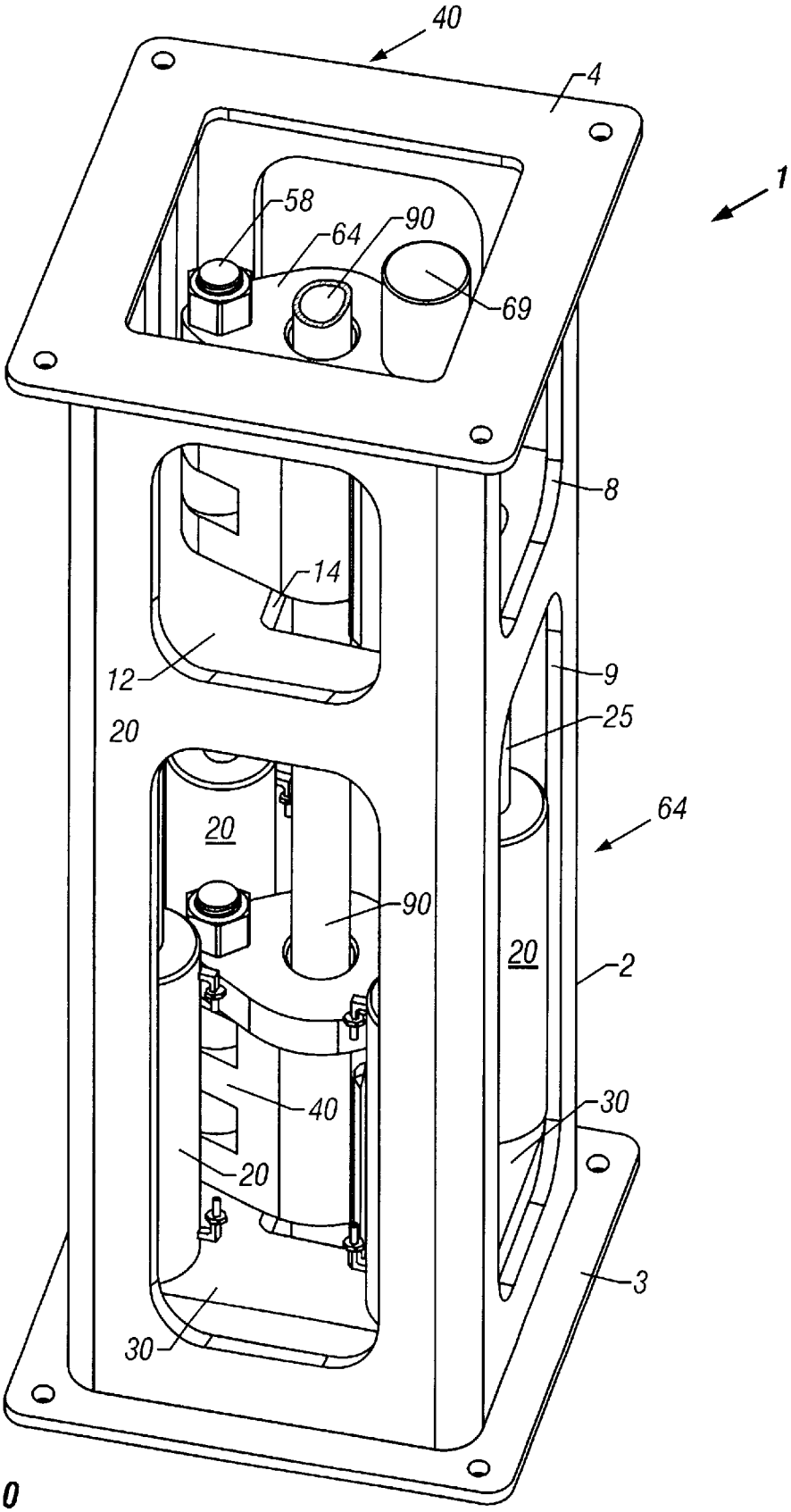
FIG. 10 is an oblique view of one embodiment of the thrust enhancement device of this invention, which utilizes the hydraulic clamp of FIG. 5.
Figure 11:
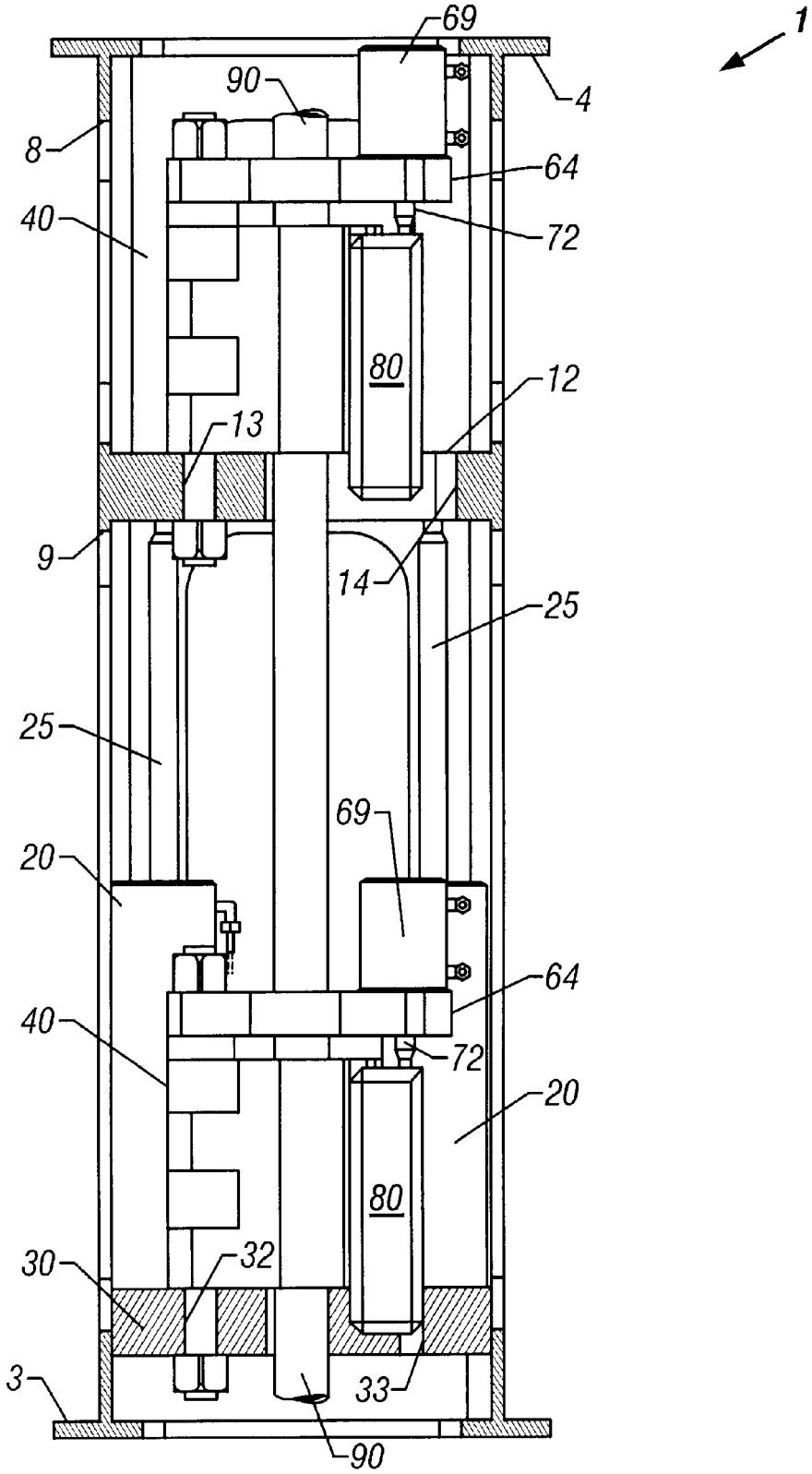
FIG. 11 is a vertical longitudinal partially sectioned view of the thrust enhancement device of FIG. 10, in a first operational position.
Figure 12:
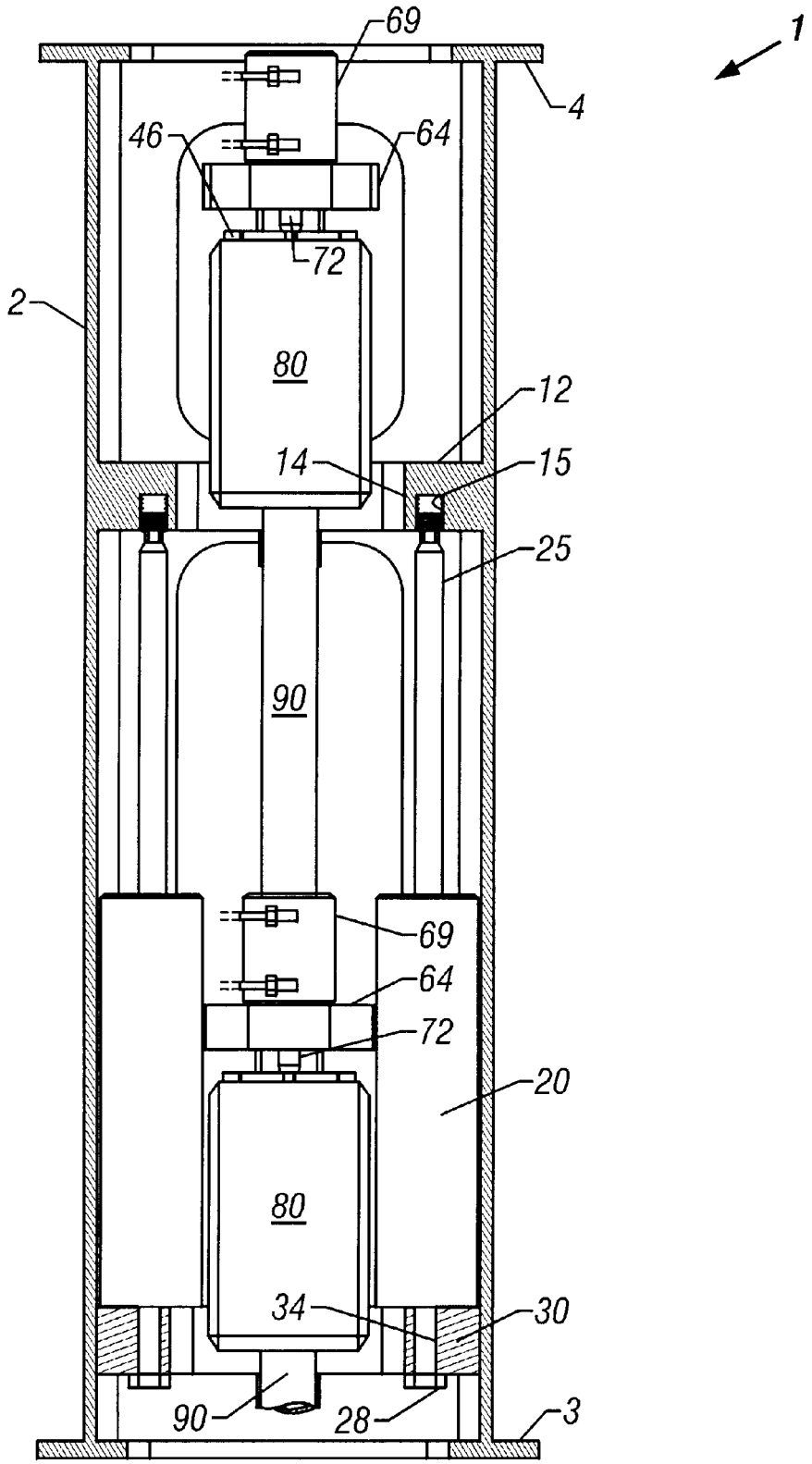
FIG. 12 is a vertical transverse partially sectioned view of the thrust enhancement device of FIG. 11 in its first operational position.
Figure 13:
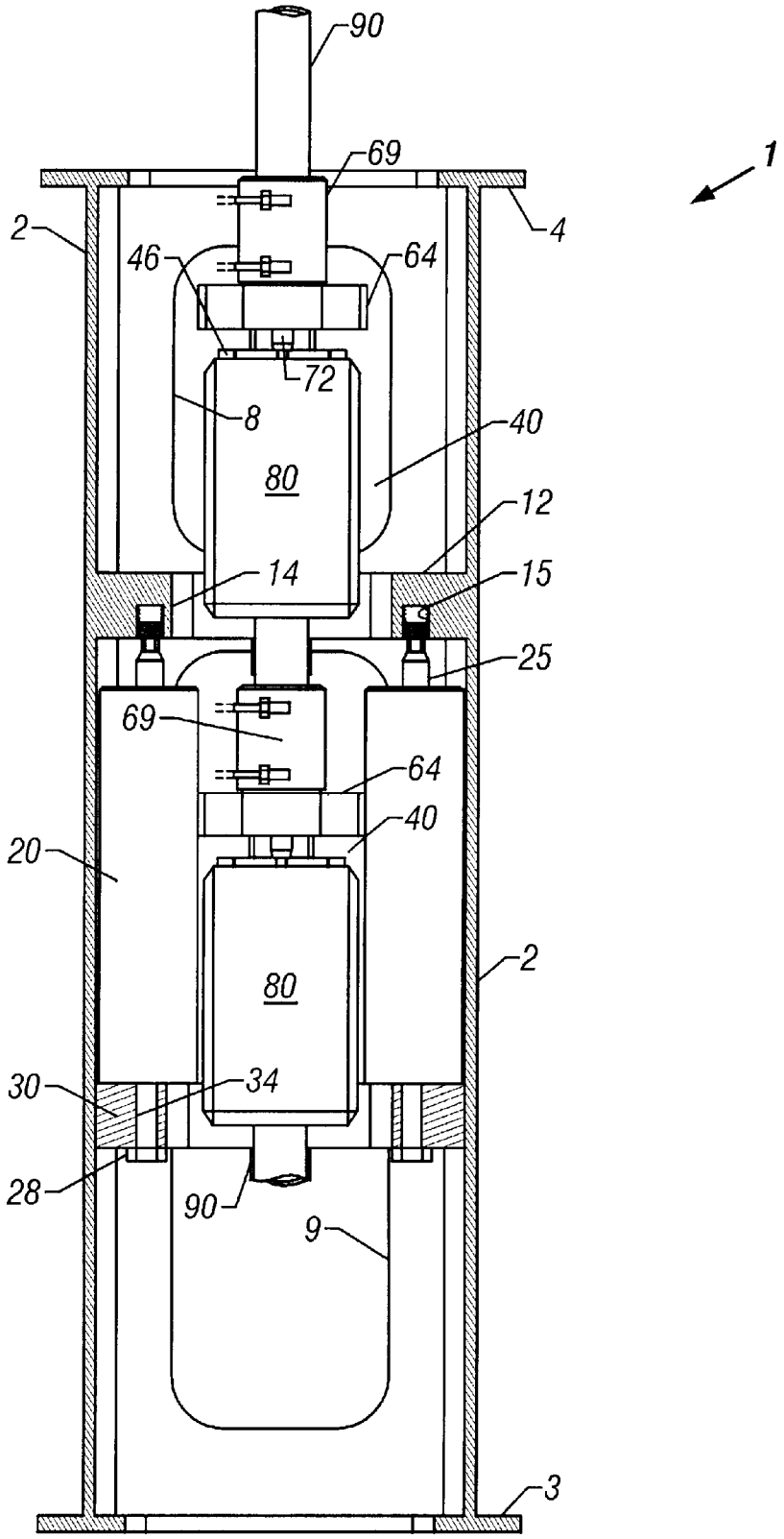
FIG. 13 is a vertical transverse partially sectioned view of the thrust enhancement device corresponding to the view shown in FIG. 12, but with the device in a second operational position.

The operation of powered tubing clamp 40 is best understood from FIGS. 6, 7, and 8. When wedge block 80 is caused to move downwardly by selectably applying hydraulic pressure to the rod extend port of the operator hydraulic cylinder assembly 69, the wedging faces of wedge cavity 81 are caused to tend to separate from the wedging outer surfaces 46 and 56 of the right-hand and left-hand grippers 41 and 51, respectively. When the wedging action is thus released by the downward shifting of wedge block 80, the Belleville spring washers 61 force the interior faces of the grippers apart through rotation about hinge shaft 58, thereby opening the clamp and causing the tubing 90 to be released by the clamp 40. The open position of the clamp 40 is also the position of the clamp during initial loading of the clamp or when the thrust enhancement device is inactive. In order to close the clamp 40 so that it will grip the tubing 90, hydraulic pressure is selectably applied to the rod return port of operator cylinder assembly 69 so that the rod 72 retracts, thereby raising wedge block 80 so that the wedging surfaces of wedge cavity 81 forcibly urge the grippers 41 and 51 to rotate together about hinge shaft 58 due to pressure on the wedging outer surfaces 46 and 56 of the clamping ears 45 and 55. When the grippers 41 and 51 have moved sufficiently together, then the tubing 90 will be tightly gripped in grooves 42 and 52.

The operation of the remotely controlled thrust enhancement device 1 proceeds as follows. Here it is assumed that the thrust enhancement device 1 is aiding in withdrawing the tubing 90 from the well. Hydraulic pressure is applied to the rod extend ports of selectably operable hydraulic thrust cylinders 20 so that moveable transverse deck 30 is caused to shift to its lowest position. During this initial downward reciprocation of the device 1, both the upper and lower tubing clamps 40 are open. After moveable transverse deck 30 has reached its lowest position, the lower clamp 40 is selectably engaged to grip the tubing 90. Hydraulic pressure is then applied to the retract the rods of thrust cylinders 20, thereby both raising the moveable transverse deck 30 and pulling the tubing 90 upwardly. When moveable transverse deck 30 reaches its upper position, upper clamp 40 is engaged and then lower clamp 40 is released from the tubing 90. Upper clamp 40 serves to hold the tubing 90 against moving downwardly back into the well. At this point, moveable transverse deck 30 is again selectable stroked downwardly for another stroke, if required. The next upward reciprocation stroke can begin when the lower clamp grips the tubing and the upper clamp then releases the tubing. When the pulling of the tubing from the well by means of reciprocating the thrust enhancement device 1 is complete, both clamps 40 are then released from the tubing. However, if the tubing must be held, then both clamps 40 can be used to grip the tubing tightly and the thrust cylinders 20 hydraulically locked in position to prevent movement. In order to force tubing into the well, the lower tubing clamp 40 on the moveable transverse deck 30 first grips the tubing at the upper position of the moveable deck 30, the grip of the upper clamp 40 is released, and the moveable is stroked downwardly. At the end of the downward reciprocation, the upper clamp 40 grips the tubing and the lower clamp releases the tubing to permit reciprocating the moveable deck upwardly for another downstroke, similarly to the procedures used for the withdrawal of tubing from the well.

The operation of the manually controlled thrust enhancement device is identical in all respects to that of the remotely controlled thrust enhancement device, with the exception of the need to manually open and close the upper and lower tubing clamps 170. The operation of the manually controlled thrust enhancement device 101 proceeds as follows. Here it is assumed that the thrust enhancement device 101 is aiding in withdrawing the tubing 198 from the well. Hydraulic pressure is applied to the rod extend ports 123 of selectably operable hydraulic thrust cylinders 120 so that moveable transverse deck 130 is caused to shift to its lowest position. During this initial downward reciprocation of the device 101, both the upper and lower tubing clamps 170 are open. After moveable transverse deck 130 has reached its lowest position, the lower clamp 170 is selectably engaged to grip the tubing 198. Hydraulic pressure is then applied to the retract the rods of thrust cylinders 120, thereby both raising the moveable transverse deck 130 and pulling the tubing 198 upwardly. When moveable transverse deck 130 reaches its upper position, upper clamp 170 is engaged and then lower clamp 170 is released from the tubing 198. Upper clamp 170 serves to hold the tubing 198 against moving downwardly back into the well. At this point, moveable transverse deck 130 is again selectable stroked downwardly for another stroke, if required. The next upward reciprocation stroke can begin when the lower clamp grips the tubing and the upper clamp then releases the tubing. When the pulling of the tubing from the well by means of reciprocating the thrust enhancement device 101 is complete, both clamps 170 are then released from the tubing. However, if the tubing must be held, then both clamps 170 can be used to grip the tubing tightly and the thrust cylinders 120 hydraulically locked in position to prevent movement. In order to force tubing into the well, the lower tubing clamp 170 on the moveable transverse deck 130 first grips the tubing at the upper position of the moveable deck 130, the grip of the upper clamp 170 is released, and the moveable deck 130 is stroked downwardly, forcing the tubing downwardly. At the end of the downward reciprocation of moveable deck 130, the upper clamp 170 grips the tubing and the lower clamp releases the tubing to permit reciprocating the moveable deck upwardly for another downstroke, similarly to the procedures used for withdrawing tubing from the well.

Advantages of the Invention

The novel thrust enhancement device for use with conventional coiled tubing injectors based on using the mechanisms of this invention offers several important advantages over using a conventional coiled tubing injector alone. Coiled tubing injectors are normally sized for a maximum service thrust based upon a certain tubing weight and well pressure plus a substantial extra allowance for the tubing motion in the well being obstructed by a shoulder, being sanded in, or the like. When the novel thrust enhancement device of this invention is used to provide the extra allowance for overcoming the obstructions to tubing motion, then the injector can be sized based its routine service requirements only. This permits the very significant advantage of using a more economical injector of smaller size and weight. The weight and cost of the thrust enhancement device of this invention are relatively small compared to the thrust delivered, so that the combination of the thrust enhancement device with a smaller injector is lighter and less expensive when compared to a large injector of equivalent thrust. This reduction in system weight is important for areas where significant weight limits are placed on transportation vehicles.

The thrust enhancement device of this invention can be used very effectively in either insertion or withdrawal of the coiled tubing in the well. Thrust capability is directly related to the piston areas of the thrust cylinders. Since use of larger thrust cylinders adds system cost and weight at a rate much less than proportional to the thrust increase ratio, a higher margin of safety can be obtained very economically for ensuring that the tubing can be withdrawn from the well. Additionally, the tubing clamping means of either of the embodiments of this invention can passively grip and hold the tubing against movement in either direction when the coiled tubing injector is not being operated, even with a leaky hydraulic system.

These and other advantages will be obvious to those skilled in the art. It may be understood readily that certain detail changes from the design herein arc still within the scope of this invention. For instance, another type of spring could be substituted for the Belleville springs used to passively release the powered tubing clamp. The wedging angles used in the powered tubing clamp could also be modified from those shown. Similarly, several variations can be made in the supporting body construction or the means for mounting the hydraulic cylinders without changing the basic principles of this invention. Likewise, power screws could be used to cause reciprocation of the moveable transverse deck holding the lower tubing clamp for the system without departing from the spirit of this invention.

What is claimed is:

1. A coiled tubing injection system for moving coiled tubing into or out of a wellbore comprising:

a coiled tubing injector;

a static tubing gripper having a closed and an open position; and a moveable tubing gripper having a closed and an open position, said movable tubing gripper being coaxially reciprocable between a first and a second position;

wherein the coiled tubing injector, the static tubing gripper and the moveable tubing gripper are positioned coaxially along a length of coiled tubing and are independently selectively operable.

2. The coiled tubing injection system of claim 1, wherein the static tubing gripper and the moveable tubing gripper each have a first and an opposed second side, said first and second sides each having an arcuate groove, an interior surface of said grooves serving as a tubing gripping surface whenever the opposed first and second sides are urged together in the closed position and wherein the said grooves are disengaged from the coiled tubing whenever the opposed first and second sides are separated.

3. The coiled tubing injection system of claim 2, wherein the static tubing gripper and the moveable tubing gripper may be independently moved into the closed position to grip the coiled tubing or independently moved into the open position to disengage the gripper from the coiled tubing.

4. The coiled tubing injection system of claim 2, wherein the first and second sides of the static tubing gripper and the moveable tubing gripper are opened or closed by a manually operated device.

5. The coiled tubing injection system of claim 2, wherein a remotely operated device is used to separate or urge together the first and second sides of the static tubing gripper and the moveable tubing gripper to open or close said grippers.

6. The coiled tubing injection system of claim 5, wherein the opposed first and second sides of the static tubing gripper and the first and second sides of the moveable tubing gripper are connected together on a back end of the opposed sides with a hinge, said hinge have an axis parallel to and offset from the axes of said grooves and wherein a front end of the first and second sides of the grippers move between the closed and the open position by the movement of a reciprocable tapered block fined over the front ends of the first and second sides, whereby when the block is in a first position the gripper is in an open position and the front ends are separated from each other and when the block is in a second position the gripper is in a closed position and the front ends arc urged together by wedging action.

7. The coiled tubing injection system of claim 6, wherein the block is reciprocated between the first and the second position by a hydraulic driver.

8. The coiled tubing injection system of claim 1, further comprising at least one hydraulic cylinder to reciprocate the moveable tubing gripper.

9. A coiled tubing injection system for moving coiled tubing into or out of a wellbore comprising:

a coiled tubing injector;

a tubular body having a static transverse deck and a moveable transverse deck, wherein the moveable transverse deck is coaxially reciprocable between a first and a second position;

a first tubing gripper attached to the static transverse deck, said first tubing gripper having a first and an opposed second side, said first and second sides having a back end, a central portion and a front end, said first and second sides being connected together on the back ends and having a circularly arcuate groove in the central portion, said first tubing gripper is in an open position when said front ends of the first and second sides are separated and in a closed position when said front ends of the first and second sides are urged together, an interior surface of said groove serving as a tubing gripping surface when said first tubing gripper is in a closed position; and a second tubing gripper attached to the moveable transverse deck, said second tubing gripper having a first and an opposed second side, said first and second sides having a back end, a central portion and a front end, said first and second sides being connected together on the back ends and having a circularly arcuate groove in the central portion, said second tubing gripper is in an open position when said front ends of the first and second sides are separated and in a closed position when said front ends of the first and second sides are urged together, an interior surface of said groove serving as a tubing gripping surface when said second tubing gripper is in a closed position, said second tubing gripper reciprocates between a first location and a second location in tandem with the reciprocation of said moveable transverse deck between the first position and second position;

wherein the coiled tubing injector, the opening and closing of the first tubing gripper, the opening and closing of the second tubing gripper and the reciprocation of the moveable transverse deck are independently selectively operable.

10. The coiled tubing injection system of claim 9, further comprising at least one hydraulic cylinder to reciprocate the moveable transverse deck between the first and second positions.

11. The coiled tubing injection system of claim 9, wherein the opening and closing of the front ends of the first and second tubing grippers are governed by the manual tightening or loosening of a fastener.

12. The coiled tubing injection system of claim 9, wherein the opening and closing of the front ends of the first and second tubing grippers are hydraulically driven.

13. The coiled tubing injection system of claim 9, further comprising a hydraulic cylinder to open and close the front ends of the first and second tubing grippers.

14. An apparatus for enhancing the thrust of a coiled tubing injector, said apparatus comprising:

a tubular body having a static transverse deck and a moveable transverse deck, wherein the moveable transverse deck is coaxially reciprocable between a first and a second position;

a hydraulic cylinder connected to the moveable transverse deck to reciprocate the moveable transverse deck between the first and second position; and a pair of tubing grippers, each gripper having a first and a second side, said first and second sides having a back end, a central portion and a front end, said first and second sides being hingedly connected together on the back ends and having a circularly arcuate groove in the central portion, said tubing grippers are in an open position when said front ends of the first and second sides are separated and in a closed position when said front ends of the first and second sides are urged together, an interior surface of said grooves serving as a tubing gripping surface when said tubing grippers are in a closed position, wherein one tubing gripper is attached to the static transverse deck and one tubing gripper is attached to the moveable tansverse deck;

whereby when the moveable transverse deck reciprocates from a first position to a second position the tubing gripper attached to the moveable transverse deck is moved from a first location to a second location.

15. A method for enhancing the thrust of a coiled tubing injector while said injector is moving coiled tubing into or out of a wellbore, said method comprising the steps of:

(a) feeding a coiled tubing through the functional path of a static tubing gripper and a moveable tubing gripper;

(b) closing the moveable tubing gripper, wherein the moveable tubing gripper grasps the surface of the coiled tubing;

(c) moving the moveable tubing gripper from a first position to a second position thereby moving the coiled tubing grasped by the moveable tubing gripper;

(d) closing the static tubing gripper, wherein the static tubing gripper grasps the surface of the coiled tubing;

(e) disengaging the moveable tubing gripper; and (h) moving the moveable tubing gripper from the second position to the first position.

16. A method for moving coiled tubing into or out of a wellbore comprising the steps of:

(a) coaxially attaching a thrust enhancer to a coiled tubing injector, said thrust enhancer comprising:

(i) a tubular body having a static transverse deck and a moveable transverse deck, wherein the moveable transverse deck is coaxially reciprocable between a first and a second position within the tubular body;

(ii) a first tubing gripper attached to the static transverse deck, said first tubing gripper having a closed and an open position, an interior surface of said first tubing gripper serving as a tubing gripping surface when said first tubing gripper is in a closed position; and (iii) a second tubing gripper attached to the moveable transverse deck and reciprocating in tandem with said moveable transverse deck, said second tubing gripper having a closed and an open position, an interior surface of said second tubing gripper serving as a tubing gripping surface when said second tubing gripper is in a closed position;

(b) feeding a coiled tubing through the functional path of the coiled tubing injector and the first and second tubing grippers;

(c) engaging the coiled tubing injector to move tubing into or out of a wellbore;

(d) closing the second tubing gripper, wherein the second tubing gripper grasps the surface of the coiled tubing;

(e) moving the moveable transverse deck from the first position to the second position;

(f) closing the first tubing gripper, wherein the first tubing gripper grasps the surface of the coiled tubing;

(g) disengaging the second tubing gripper; and (h) moving the moveable transverse deck from the second position to the first position;

whereby the thrust applied to the coiled tubing is greater than the thrust applied by the coiled tubing injector or the thrust enhancer alone.

17. A method for moving coiled tubing into or out of a wellbore comprising the steps of:

(a) coaxially attaching a thrust enhancer to a coiled tubing injector, said thrust enhancer comprising:

(i) a tubular body having a static transverse deck and a moveable transverse deck, wherein the moveable transverse deck is coaxially reciprocable between a first and a second position within the tubular body; and (ii) a first and second tubing gripper, said grippers having a first and a second side, said first and second sides having a back end, a central portion and a front end, said first and second sides being connected together on the back ends and having a circularly arcuate groove in the central portion, said tubing grippers arc in an open position when said front ends of the first and second sides are separated and in a closed position when said front ends of the first and second sides are urged together, an interior surface of said grooves serving as a tubing gripping surface when said tubing grippers are in a closed position, wherein the first tubing gripper is attached to the static transverse deck and the second tubing gripper is attached to die moveable tansverse deck;

(b) feeding a coiled tubing through the functional path of the coiled tubing injector and the grooves of the first and second tubing grippers;

(c) engaging the coiled tubing injector to move tubing into or out of a wellbore;

(d) closing the second tubing gripper, wherein the second tubing gripper grasps the surface of the coiled tubing;

(e) moving the moveable transverse deck from the first position to the second position;

(f) closing the first tubing gripper, wherein the first tubing gripper grasps the surface of the coiled tubing;

(g) disengaging the second tubing gripper; and (h) moving the moveable transverse deck from the second position to the first position;

whereby the thrust applied to the coiled tubing is greater than the thrust applied by the coiled tubing injector or the thrust enhancer alone.

18. A method for moving coiled tubing into or out of a wellbore, said method comprising the steps of:

(a) coaxially attaching a thrust enhancer to a coiled tubing injector, said thrust enhancer comprising:

(i) a tubular body having a static transverse deck and a moveable transverse deck, wherein the moveable transverse deck is coaxially reciprocable between a first and a second position within the tubular body;

(ii) a hydraulic cylinder connected to the moveable transverse deck to reciprocate the moveable transverse deck between the first and second positions; and (iii) a first and second tubing gripper, said grippers having a first and a second side, said first and second sides having a back end, a central portion and a front end, said first is and second sides being connected together on the back ends and having a circularly arcuate groove in the central portion, said tubing grippers are in an open position when said front ends of the first and second sides are separated and in a closed position when said front ends of the first and second sides are urged together, an interior surface of said grooves serving as a tubing gripping surface when said tubing grippers are in a closed position, wherein the first tubing gripper is attached to the static transverse deck and the second tubing gripper is attached to the moveable tansverse deck;

(b) feeding a coiled tubing through the functional path of the coiled tubing injector and the grooves of the first and second tubing grippers;

(c) engaging the coiled tubing injector to move tubing into or out of a wellbore;

(d) closing the second tubing gripper, wherein the second tubing gripper grasps the surface of the coiled tubing;

(e) activating the hydraulic cylinder to move the moveable transverse deck in the direction of movement of the coiled tubing through the coiled tubing injector, wherein the moveable transverse deck moves from the first position to the second position;

(f) closing the first tubing gripper, wherein the first tubing gripper grasps the surface of the coiled tubing;

(g) disengaging the second tubing gripper;

(h) moving the moveable transverse deck from the second position to the first position; and (i) repeating the sequence of steps from (c) through (h);

whereby the thrust applied to the coiled tubing is greater than the thrust applied by the coiled tubing injector or the thrust enhancer alone.

19. The method of claim 18, wherein the front ends of the first and second sides of the first and second grippers move between the open and closed positions in response to the movement of a reciprocable tapered block fined over the front ends of the first and second sides, wherein the block is in a first position the front ends are separated and when the block is in a second position the front ends are urged together by the tapered block.

20. The method of claim 19, wherein the block is reciprocated between the first and the second positions by a hydraulic driver.

* * * * *